US006644343B2

(12) United States Patent
Bethuy et al.

(10) Patent No.: US 6,644,343 B2
(45) Date of Patent: Nov. 11, 2003

(54) ELECTRONICALLY CONTROLLED BEVERAGE DISPENSER

(75) Inventors: Timothy W. Bethuy, Cedar, MN (US); Douglas P. Goulet, Big Lake, MN (US)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 10/244,905

(22) Filed: Sep. 16, 2002

(65) Prior Publication Data

US 2003/0094005 A1 May 22, 2003

Related U.S. Application Data

(63) Continuation of application No. 08/959,180, filed on Oct. 28, 1997, now Pat. No. 6,449,966, which is a continuation of application No. 08/247,613, filed on May 23, 1994, now Pat. No. 5,732,563, which is a continuation of application No. 08/125,377, filed on Sep. 22, 1993, now abandoned.

(51) Int. Cl.[7] ..... F16K 21/18; G01F 23/00

(52) U.S. Cl. ..... 137/392; 62/188; 73/304 R; 236/780; 340/620

(58) Field of Search ..... 73/304 R; 137/392; 340/620; 236/78 D; 62/188

(56) References Cited

U.S. PATENT DOCUMENTS 4,728,005 A * 3/1988 Jacobs et al. ..... 222/64
5,207,379 A * 5/1993 Hurmi et al. ..... 236/78 D
5,923,102 A * 7/1999 Koenig et al. ..... 307/118

* cited by examiner

*Primary Examiner*—William Wayner
(74) *Attorney, Agent, or Firm*—Sten Erik Hakanson

(57) ABSTRACT

An electronic control for the operation of a beverage dispenser of the refrigerated ice bank type is shown. The control provides for reliable determinations of when ice production is needed and when it is not needed. A microprocessor receives information from an ice bank probe and from a temperature probe located within the ice bank. Data collected by the microprocessor from both the ice bank probe and the temperature probe is used to determine if the ice bank is either insufficient in size and should be increased or is of sufficient size such that the compressor can be turned off. A carbonator level probe is also shown and connected to the microprocessor. The microprocessor is programmed whereby the carbonator probes are sampled in a manner to accurately determine the level of water in the carbonator and therefore the need for turning on or turning off any water pump connected thereto. Both the operation of the compressor and the water pump are controlled by the microprocessor wherein the programming thereof provides for adequate hysteresis protection so that short cycling of the compressor and water pump is avoided.

7 Claims, 23 Drawing Sheets

80
86
72
84
74
81
78
80
W
70
83
82
102
98
99
96a
106
108
100
92a
82
76
96b
100
106a
108a
109a
105
104
94
105
90
92b 142
144
24VACHI
J2
SNFT_PWR
Q5
R23
C16
R22
ISO2
VCC
R26
DII
RED
SNFT_OUT
A
VREF
R6
R3
R8
U2D
VCC
R7
C2
VREX
J3

START
200
PROBE ON AND WAIT
202
TAKE 4 READINGS
204
TURN OFF PROBE 1
206
TURN ON PROBE 2 AND WAIT
208
TAKE 4 READINGS
210
TURN OFF PROBE 2
<2 MILISECONDS
212
AVERAGE RESULTS
214
MAKE ICE MODE SET ?
NO
YES
216
IS AVERAGE< LOW SET POINT ?
NO
YES
222
IS AVERAGE> HIGH SET POINT ?
NO
YES
224
CHANGE TO STOP MAKE ICE MODE
226
LED OFF
218
CHANGE TO MAKE ICE MODE
220
LED ON
EXIT

START

350
IS PUMP RUNNING ?
NO
YES
354
HAS PUMP RUN-TIME EXCEEDED SETPOINT ?
NO
YES
356
RESET TIMER
PULSE SNIFTER
MULTI-MINI PULSES
352
ACCUMULATE RUN TIME
RETURN

ELECTRONICALLY CONTROLLED BEVERAGE DISPENSER

The present application is a continuation based upon U.S. Ser. No. 08/959,180 filed Oct. 28, 1997, now U.S. Pat. No. 6,449,966 which was a continuation of U.S. Ser. No. 08/247,613 filed May 23, 1994, now U.S. Pat. No. 5,732,563, which was continuation of Ser. No. 08/125,377 filed Sep. 22, 1993, now abandoned.

FIELD OF THE INVENTION

The present invention relates to beverage dispensers and in particular electronically controlled beverage dispensers of the ice bank type.

BACKGROUND OF THE INVENTION

Beverage dispensers are well known in the art and are typically used to dispense carbonated beverages consisting of a combination of syrup and carbonated water. Beverage dispensers of the ice bank variety use refrigeration equipment including a compressor, condenser and evaporator to form an ice bank around the evaporator coils. The ice bank is suspended in a tank of cold water and provides a cooling reserve for the carbonated water and syrup beverage constituents.

A major problem with the ice banks concerns the regulation of the size thereof. Mechanical and electromechanical controls are known, however such controls can be slow to respond and therefore result in wider than desired fluctuation in the size of the ice bank. Electronic controls are known whereby a pair of probes determine the presence of ice or water as a function of the conductivity thereof. However, early electronic controls suffered from reliability problems, and the probes over time can become corroded and therefore provide unreliable information. Furthermore, both mechanical and electronic controls have the problem of hysteresis management wherein undesirable short cycling of the refrigeration compressor can occur. Such prior art controls have not been able to determine with a high degree of certainty if ice is present, and if so is there is sufficient thickness that further ice production should be terminated.

A similar problem exists in current art beverage dispensers with respect to the carbonator. The carbonator, of course, is the vessel wherein plain water and carbon dioxide are combined to produce the carbonated water. Typically, a carbonator includes a probe positioned therein having high and low probe contact points for electronically determining the level of water within the carbonator. Specifically, the probes determine the presence of water or air with respect to the difference in electrical resistance there between. Prior art level controls of this type, as with ice bank controls, suffer with the problem of accuracy. The interior of the carbonator is a dynamic environment where water and carbon dioxide are being combined causing turbulation and spray. Thus, it has always been difficult to know if the water is in fact sufficiently low to require water to be pumped to the carbonator. Since it is difficult to know the level of the water in the tank, it is also difficult to build in any form of hysteresis control so that the pump is not short cycled.

A further problem with prior art dispensers of the ice bank type concerns the control of the agitator motor. The agitator motor is used to circulate water within the water tank in which the ice bank resides to enhance heat exchange between the ice and the water and ultimately the beverage constituents. In such prior art dispensers agitator motors are generally operated continuously. However, such use of electrical power is wasteful, especially during periods of time wherein the dispenser is not in use. Thus, it would be desirable to operate the agitator motor more in accordance with the actual need thereof.

It is also known that the carbonator can become less effective at carbonating plain water over time. This can occur as a result of oxygen and other gases entrained in the water being released therefrom within in the carbonator. Eventually, the air space within the carbonator that is ideally totally carbon dioxide, can include a substantial percentage of oxygen, nitrogen, and so forth. Thus, various strategies have been proposed to use a solenoid operated valve to periodically vent air from the carbonator air space and replace it with carbon dioxide. However, such devices typically purge air from the carbonator based upon a predetermined time lapse. It would be more desirable to purge the carbonator based more directly upon the actual presence of contaminating gases as opposed to the lapse of a predetermined period of time where such purging may occur needlessly.

SUMMARY OF THE INVENTION

The present invention is an electronic control for use with a beverage dispenser, and particular a beverage dispenser of the ice bank type. Such a beverage dispenser includes a water tank for holding a volume of water. The water is refrigerated by an evaporator suspended therein and connected to a compressor and a condenser. A fan motor is used to cool the condenser. A plurality of syrup lines extend through the tank for cooling thereof and are connected to a plurality of beverage dispensing valves secured to the beverage dispenser. In the preferred embodiment, a carbonator is positioned within the water tank to provide for direct cooling thereof. The carbonator includes a level sensor having low and high sensing contact points and includes a solenoid operated safety valve. The carbonator has a plurality of carbonated water lines extending therefrom for connection to the plurality of beverage dispensing valves. An agitator motor is secured to the dispenser and includes a shaft and an agitating plate for providing movement of the water in the water bath. An ice bank sensor is positioned within the water bath with respect to the evaporator coils to provide for the formation of the desired sized ice bank on the evaporator coils. The ice bank sensor includes two probes across which an electrical pulse can be generated. A temperature sensing probe is positioned with respect to the evaporator coils so that it exists centrally within the ice bank. A water pump provides for pressurized delivery of plain water to the carbonator tank.

The electronic control of the present invention includes a microprocessor connected to and receiving information from the ice bank sensor, the temperature sensor and the carbonator level sensor. In turn, the microprocessor is connected to and provides for the control, of the solenoid safety valve, the agitator motor, the water pump and the compressor. Of course, the ice bank sensor, the temperature sensor, the carbonator level sensor, the solenoid safety valve, the agitator motor, the water pump and the compressor all have specific circuitry associated therewith through which the microprocessor exercises control and receives information. Power is supplied to the microprocessor by a regulated supply and further input is provided thereto by a zero crossing circuit. A constant reference voltage circuit is supplied to the microprocessor and to the ice bank probe and carbonator probe.

The microprocessor is programmed to control the ice bank sensor and related circuitry wherein a DC signal is alternately permitted to flow in opposite directions between the two probes thereof.

The microprocessor is programmed to control the ice bank sensor and related circuitry wherein the presence or not of ice is determined by the change in resistance to electrical flow between the probes thereof. However, unlike the prior art a DC signal is alternately permitted to flow in opposite directions between the two probes thereof. Moreover, this energizing of the probes only occurs when readings are to be taken, otherwise there is no potential there between. Furthermore, it was found that if each sampling occurs for a period of time of less than 4 milliseconds, corrosive deposition from one probe to the other can be avoided. Also, the alternating of the direction of the current flow further serves to negate any deposition that could occur over time as well as permit the use of DC current which allows for simpler and less costly circuitry than with the use of AC current as seen in the prior art. The sampling is controlled by software wherein 8 readings are taken after which the two highest and two lowest readings are thrown out and the remaining four are averaged. The resulting reading is compared to high and low set points that have been experimentally determined based upon the known range of water qualities as well as the particular dimensions of the ice sensor, its specific performance in water of varying ionic and particulate content and so forth. Thus, the compressor will be signaled to turn on to build the ice bank if the sensed resistance is below the low set point, and conversely will be turned off if the averaged reading is above the high set point. No change in the current state, whether it be make ice or not make ice, will occur if the averaged reading is between the low and high set points. The high and low set points therefore provide for hysteresis management so that the determination of the existence of ice or not over the probes can be done with a high degree of reliability. In addition, a reading of the temperature probe is also taken simultaneously with the determination of the resistance between the ice bank probes. If the determination is that ice is present over the probes, an increment, in the present case 0.9 degrees F. as experimentally determined, is subtracted from the current ice bank temperature reading. Rather than immediately turning off the compressor, it is left running until the ice bank temperature probe reads this lower temperature. As is understood by those of skill, to increase the size of an ice bank requires the refrigeration system to work progressively harder. Thus, there is a correlation between the temperature within the ice bank and its overall size or thickness. Therefore, by permitting the compressor to run based upon the temperature of the ice bank, a further desired amount of ice can be safely and accurately added to the ice bank beyond the physical position of the probes. In addition, ambient load proportionally affects the amount of ice which is added to the ice bank. The product of the refrigeration system cooling rate and the ice thickness forms the basis for determining the amount of ice added. As the ambient load increases, the refrigeration cooling rate decreases, forming increased or additional ice reserve compared to nominal ambient loads. The increased ice reserve is beneficial to provide additional cooling reserve when needed in higher ambients. The reverse also hold true wherein lower than nominal ambients will produce less ice when additional cooling is not needed. It can be seen that such an approach further protects against undesirable short cycling of the compressor as is not turned off at the first indication of ice at the ice sensing probes, which particularly during a period of high volume beverage dispensing, could very quickly result in melting of that ice and a determination that ice should again be produced.

The carbonator probes also use a DC signal, but, unlike the ice bank sensor probes. since the current flow is not between the high and low water level probes but between each probe and the grounded carbonator tank, reversal of such flow is not necessary. However, in the carbonator level sensing circuit, like that of the ice bank sensing circuit, current is not present at the high and low probes unless readings are being taken. The microcontroller software then directs the sampling of each probe 64 times in time spans of less than 4 milliseconds to prevent any corrosive degradation. The 64 samples provide for determining with high reliability that each probe is either in air or water. If they are both in air the water pump is turned on, if they are both in water the pump is turned off. If the high and low water level probes disagree, that is, one is in air and the other in water, then no change is made to the current pump operation.

The carbonator safety valve is operated periodically based upon an accumulation of pump run time. Thus, unwanted gases are released from the carbonator based upon a factor that relates directly to the presence of those unwanted gases therein.

The agitator motor is operated as a function of the temperature sensed by the temperature probe during initial start up of the dispenser when no ice is present on the evaporator coils. Also, the agitator is operated on the basis of whether or not the compressor and/or the carbonator pump have been running during a predetermined time period. Thus, if no drinks have been drawn during the predetermined time period, as indicated by no running of the water pump, or the compressor has not been running during that time period, also indicating no drink dispensing requiring ice bank replenishment, the agitator is turned off. Such agitator control was found to decrease the amount of time needed for and initial pull down forming a full ice bank, and to save energy by not running the agitator motor and not running the compressor to replace ice needlessly eroded by constant running of the agitator.

DESCRIPTION OF THE DRAWINGS

A further understanding of the structure, operation, and objects and advantages of the present invention can be had by referring to the following detailed description which refers to the following figures, wherein.

DETAILED DESCRIPTION

Figure 1:
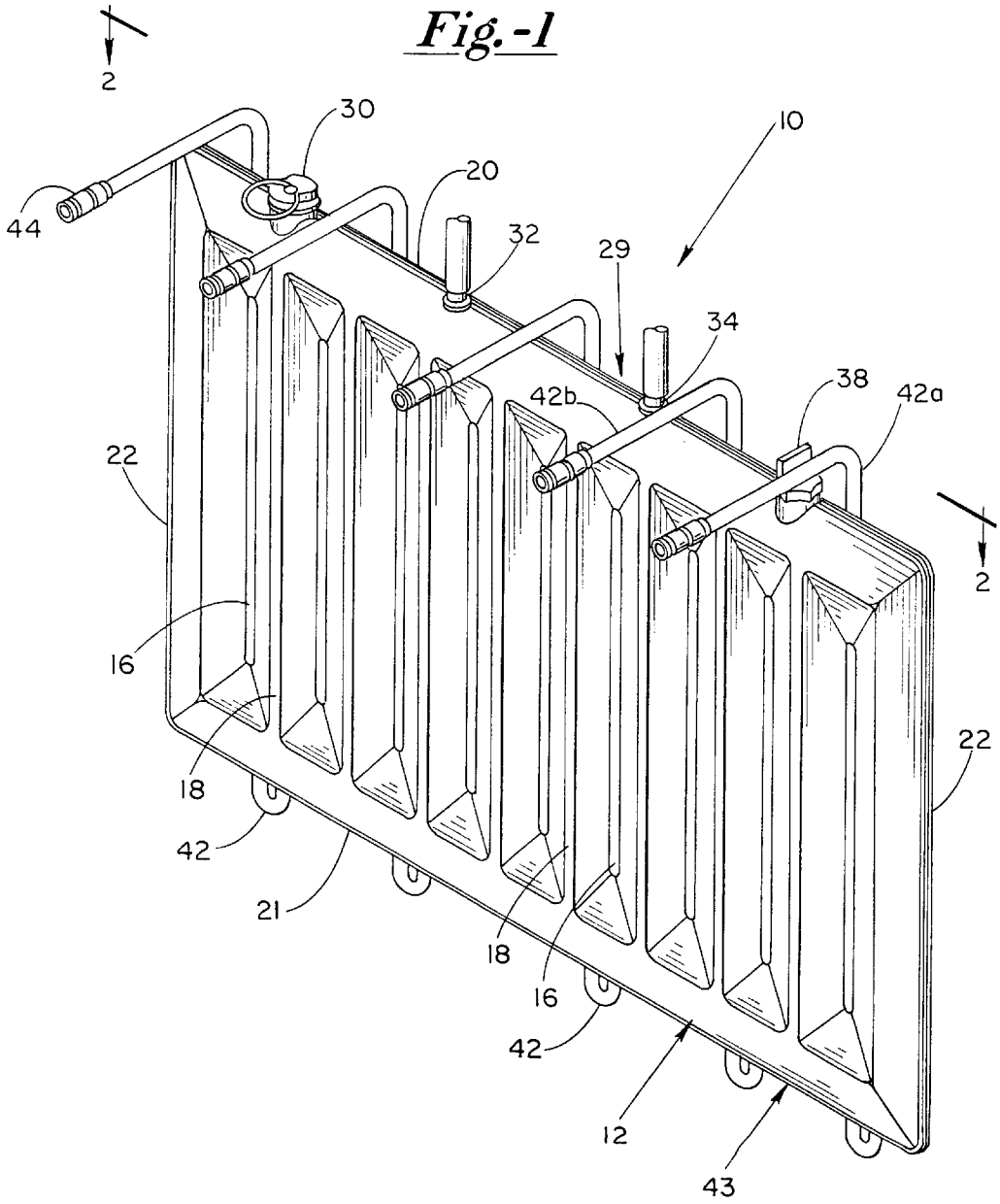
FIG. 1 shows a perspective view of a carbonator.
Figure 2:
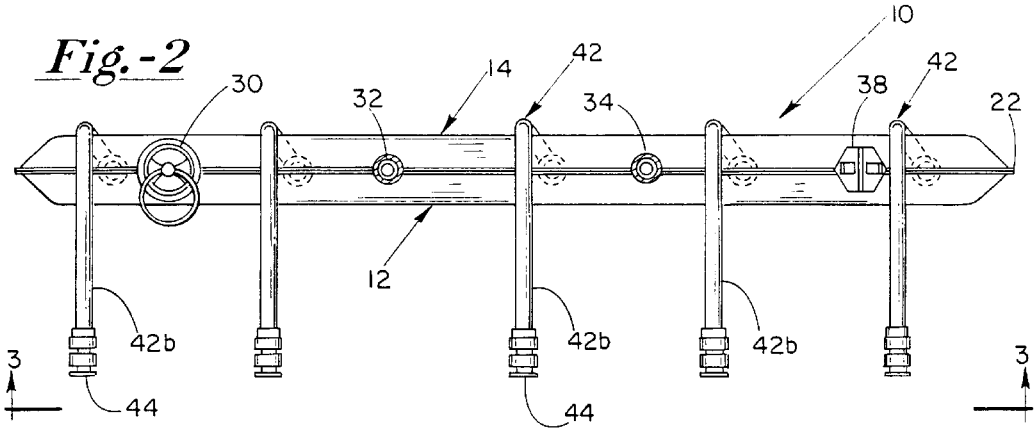
FIG. 2 shows a top plan view along lines 2—2 of FIG. 1.
Figure 3:
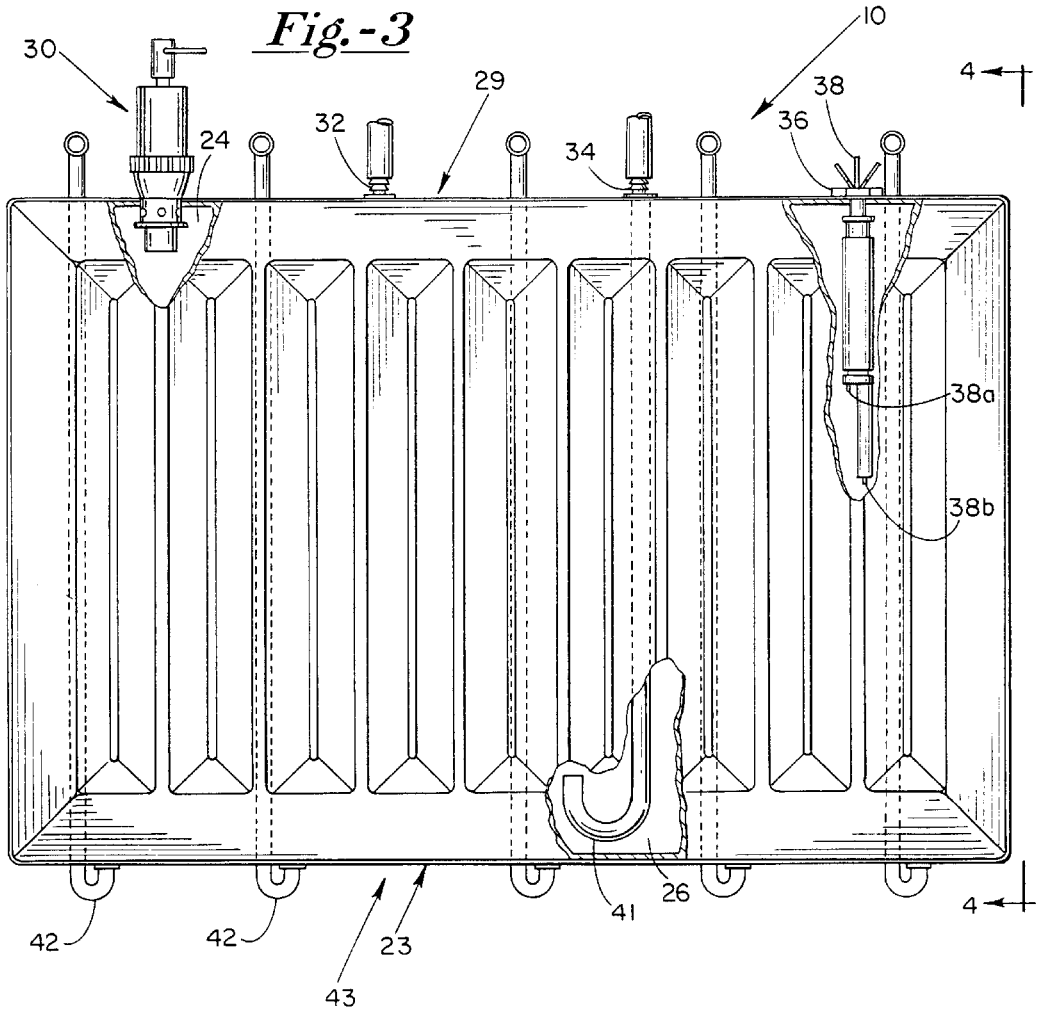
FIG. 3 shows a partial cross-sectional side plan view along lines 3—3 of FIG. 2.
Figure 4:
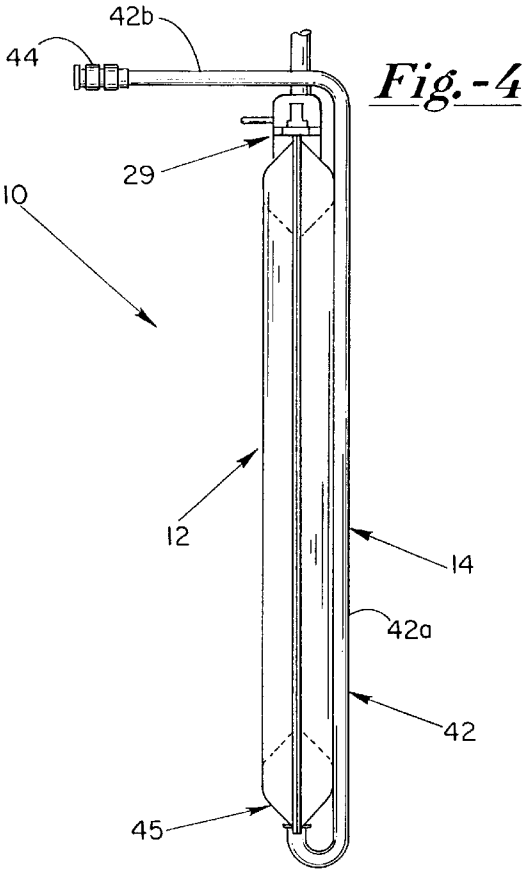
FIG. 4 shows an end plan view long lines 4—4 of FIG. 3.
Figure 5:
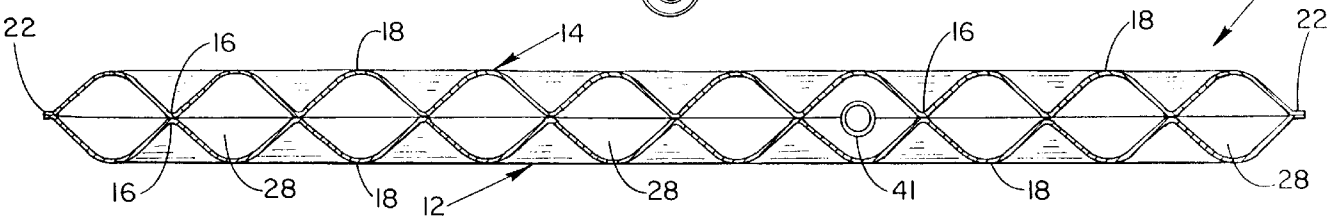
FIG. 5 shows a cross-sectional view along lines 5—5 of FIG. 3.

A carbonator is seen in FIGS. 1–5 and generally is referred to by the numeral 10. As seen therein, carbonator 10 includes a first half 12 and a second half 14. Halves 12 and 14 are made from a suitable sheet metal such as 18 gauge stainless steel. In particular, they are cold drawn to form an alternating pattern of seams 16 and ridges 18. Halves 12 and 14 are welded together around their respective perimeter edges having top and bottom perimeter edge portions 20 and 21 respectively and side edge portions 22, and along corresponding seams 16, to form the carbonator tank 22. It can be seen that tank 23 includes a top tank volume area 24, a bottom area 26 and a plurality of vertical column areas 28. The top and bottom areas 24 and 26 provide for fluid communication between the columns 28. A top end 29 of tank includes a solenoid operated pressure relief valve 30, a carbon dioxide inlet fitting 32, a water inlet fitting 34 and a level sensor fitting 36 for retaining a water level sensor 38. Sensor 38 includes a high level sensing contact 38*a*, and a low level sensing contact 38*b* that are connected by a pair of wires 40 to control means described in greater detail below. A J-tube 41 is secured to fitting 34 and extends within a column 28.

A plurality of carbonated water lines 42 extend from a bottom end 43 of tank 23 and include vertical portions 42*a* that travel upwardly closely along and adjacent first half 12 and then extend with horizontal portions 42*b* over end 29 and outwardly therefrom in a direction towards side 14 and terminate with beverage valve fittings 44.

Figure 6:
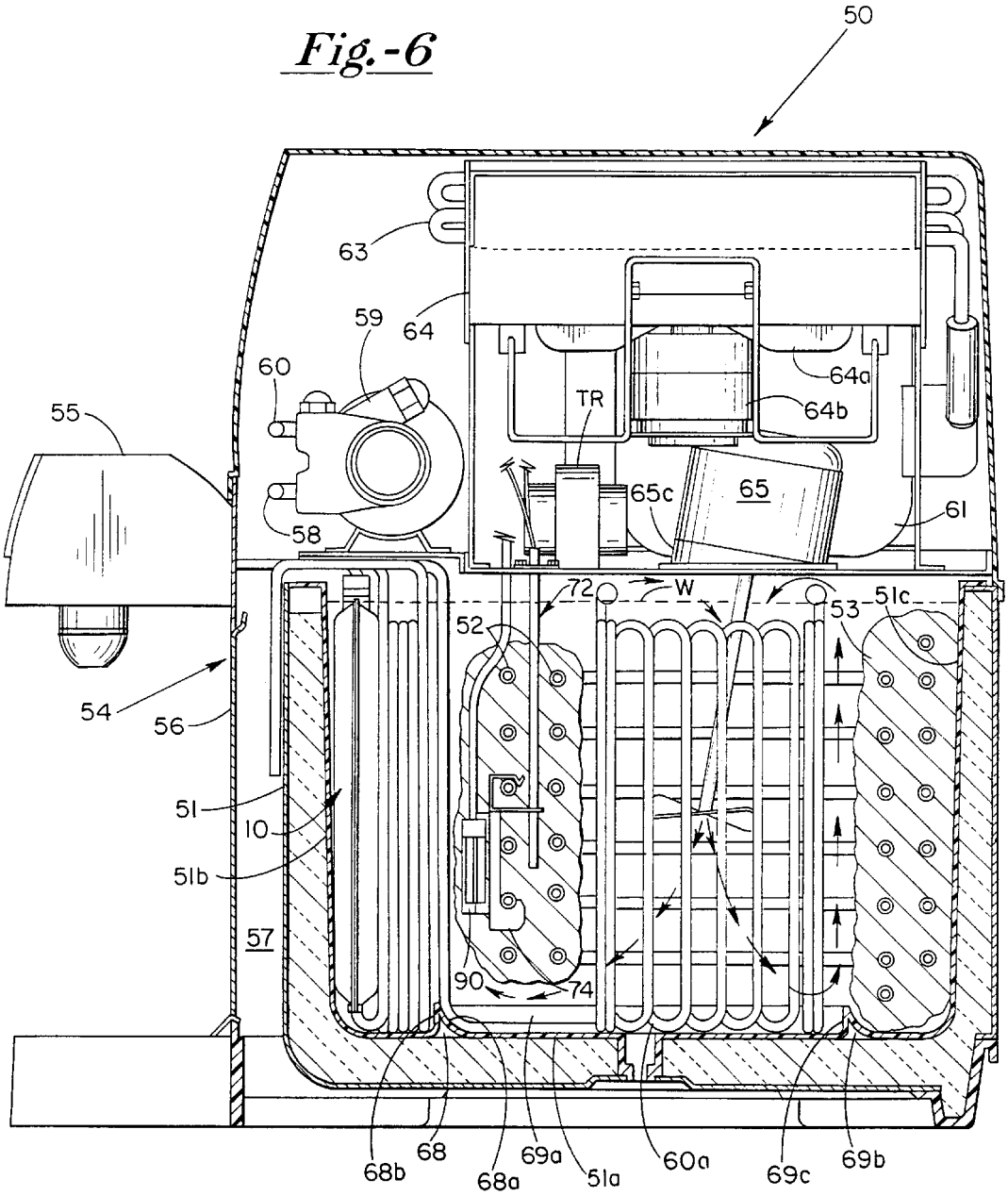
FIG. 6 shows a side plan partial cross-sectional view of an ice bank cooled beverage dispenser.
Figure 7:
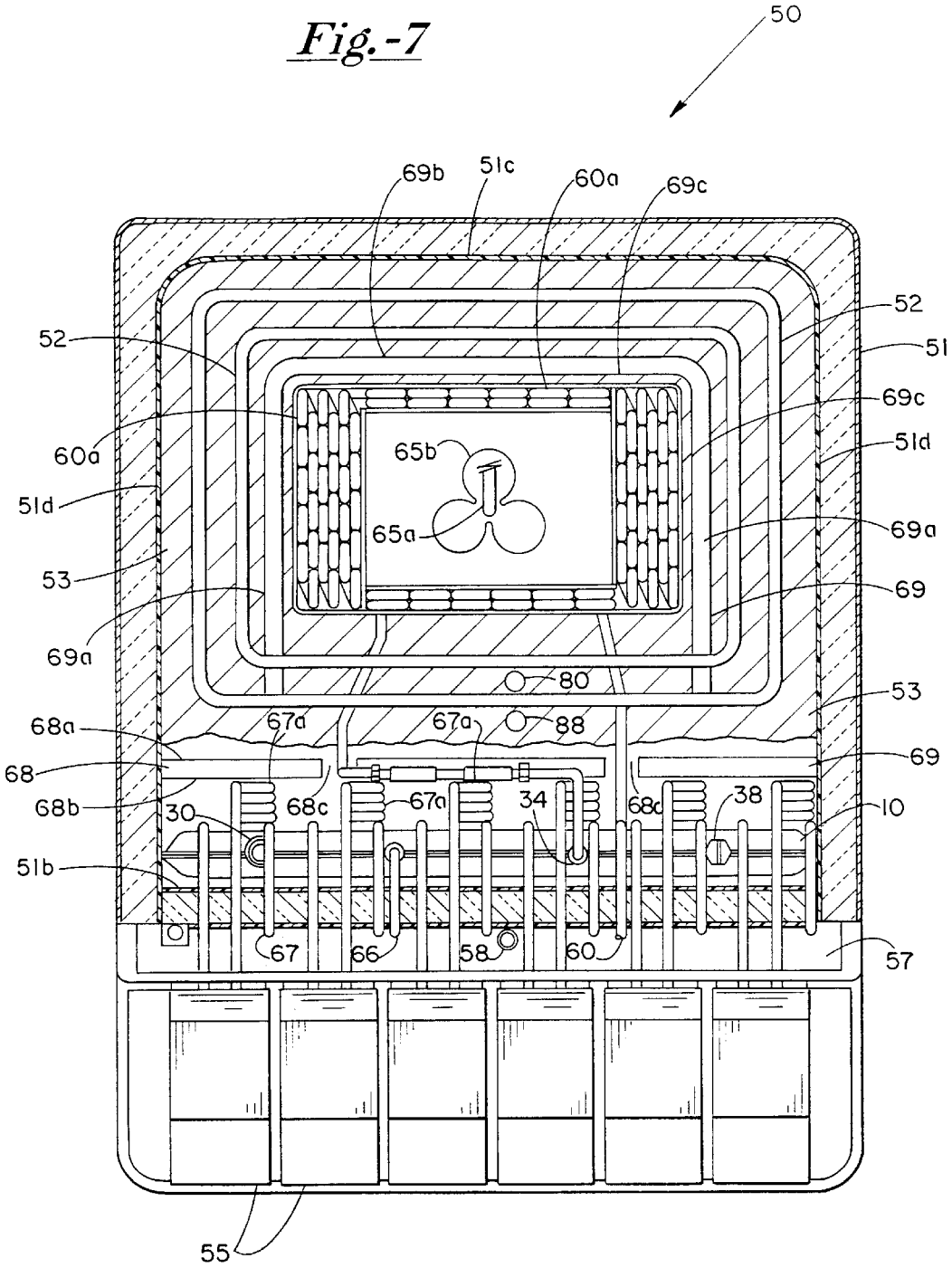
FIG. 7 shows a top plan view along lines 7—7 of FIG. 6.

As is seen by referring to FIGS. 6 and 7, carbonator 10 is shown in an ice bank type of beverage dispenser 50. As is known in the art, dispenser 50 includes an insulated water bath tank 51 having a bottom surface 51*a*, a front surface 51*b*, and rear surface 51*c* and two side surfaces 51*d*. A plurality of evaporator coils 52 are held substantially centrally within tank 51 and substantially below a surface level W of water held in tank 51 for producing an ice bank 53 thereon. Carbonator 10 is located within tank 50 and adjacent a front end 54 of dispenser 50. In particular, dispenser 50 includes a plurality of beverage dispensing valves 55 secured to the front end 54. It can be understood that carbonated water fittings 44 allow lines 42 to be hard-plumbed directly to each valve 55. A transformer marked TR is connected to an AC line voltage supply and provides 24VAC current to the valves 55. Dispenser 50 also includes a removable plate 56 that provides access to a space 57 between plate and tank 50. A water delivery line 58 is connected to a source of potable water and routed through space 57 to a water pump 59. Pump 59 pumps water through a line 60 to carbonator 10. The majority of the length of line 60 consists of a serpentine coil 60*a* submerged in tank 50 to provide for cooling of the water flowing there through. Coil 60*a* is arranged in four convoluted or serpentine portions centrally of evaporator coils 53. Evaporator coils 53 are, as is known in the art, connected to a refrigeration system. Specifically, the refrigeration system main components include, a refrigeration compressor 61 secured to a top deck floor 62, a condenser 63 held by a support and air directing shroud 64 above a cooling fan 64*a* operated by a motor 64*b*. An agitator motor 65 includes a shaft 65*a* and a turbulator blade 65*b* on an end thereof, and is secured at an angle to floor 62 by an angled support 65*c*. A carbon dioxide gas delivery line 66 is routed through space 57 and is connected to gas inlet 32. Each valve 55 is connected to a syrup line 67. Lines 67 are each connected to a source of syrup and are also initially routed through space 57 and then consist of a plurality of loops positioned closely adjacent carbonator 10 in tank 51. Lines 67 then terminate by direct hard plumbing to valves 55 as the ends thereof come up and over carbonator top end 29. Tank 51 includes a front ridge 68, and a U-shaped ridge 69, integrally molded into bottom surface 51*a* thereof. Ridge 68 includes an angled surface 68*a*, and extends across the width of tank 51 from one side 51*d* to the other. Ridge 69 has two parallel components 69*a* extending in a direction from dispenser front end 56 to the rear end opposite therefrom, and a component 69*b* perpendicular thereto and extending there between forming the "U" shape. Ridge portion 69*a* and 69*b* each include a portion 69*c* that extends transversely to tank bottom 51*a*.

Figure 8:
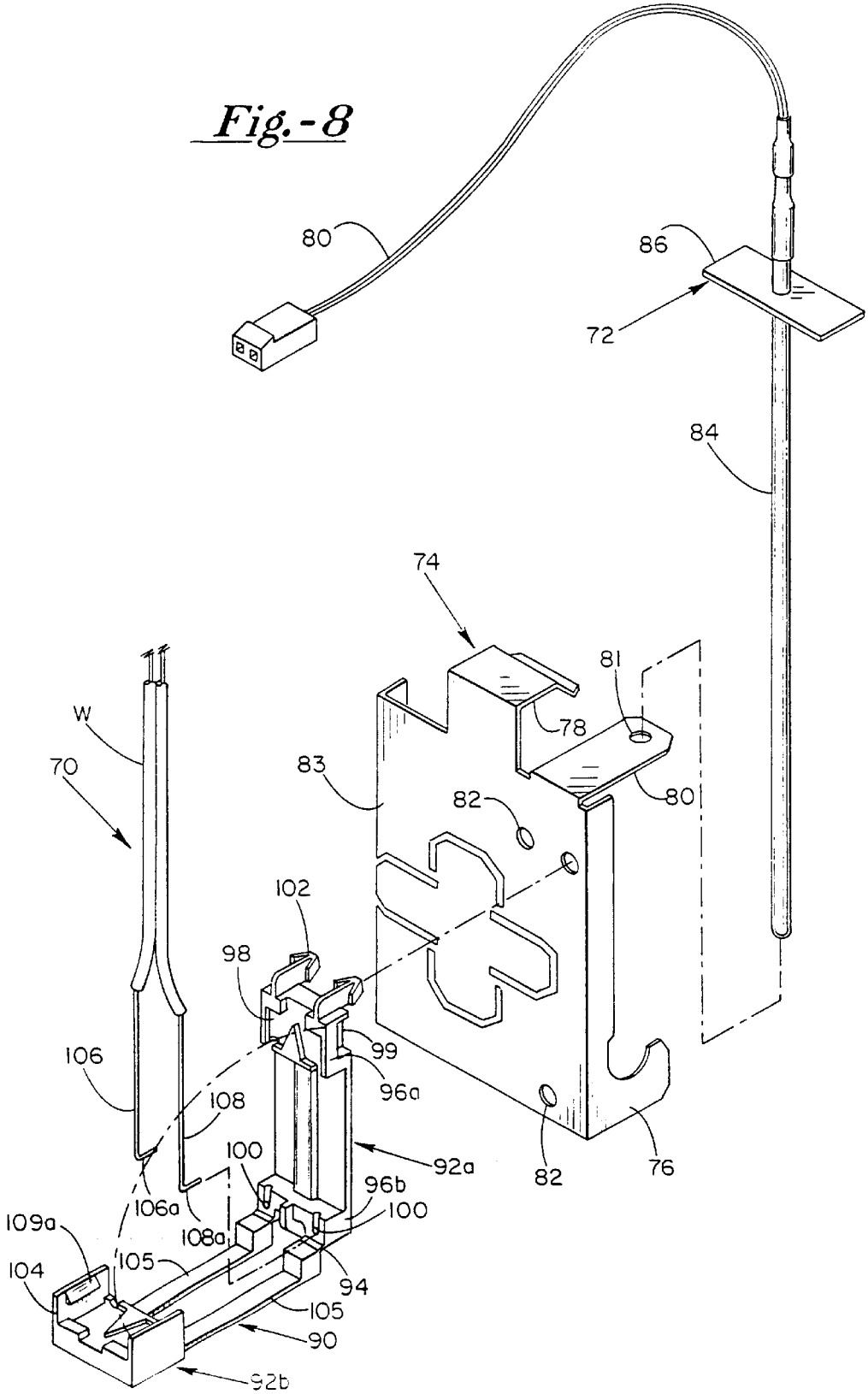
FIG. 8 shows an enlarged exploded view of the ice bank probe, temperature probe and evaporator coil mounting plate.
Figure 10:
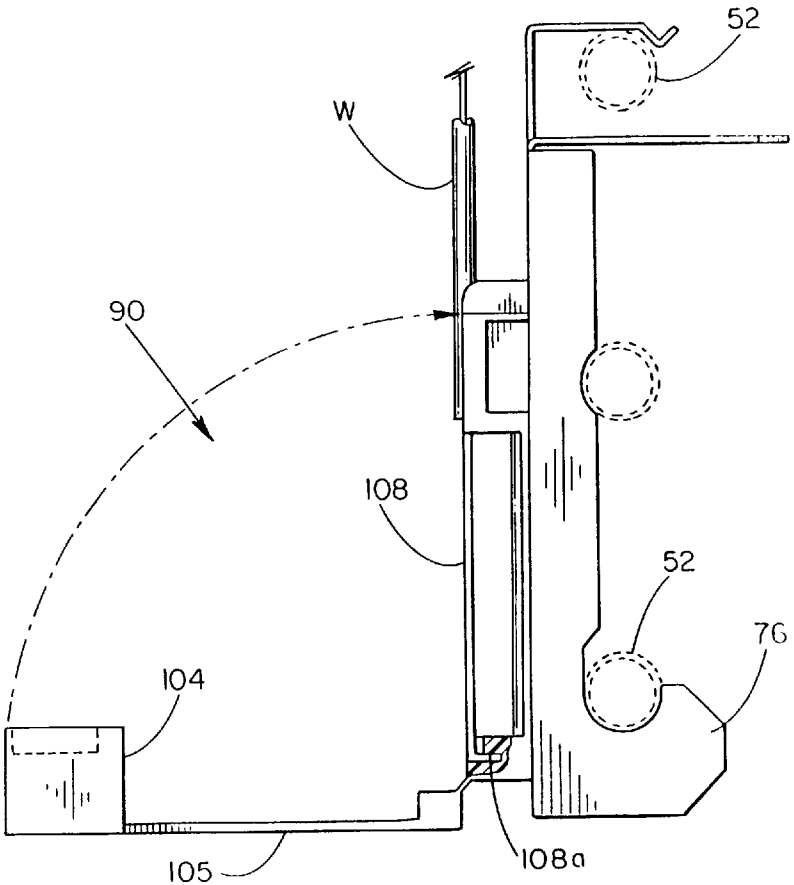
FIG. 10 shows a side plan view along lines 10—10 of FIG. 9.
Figure 9:
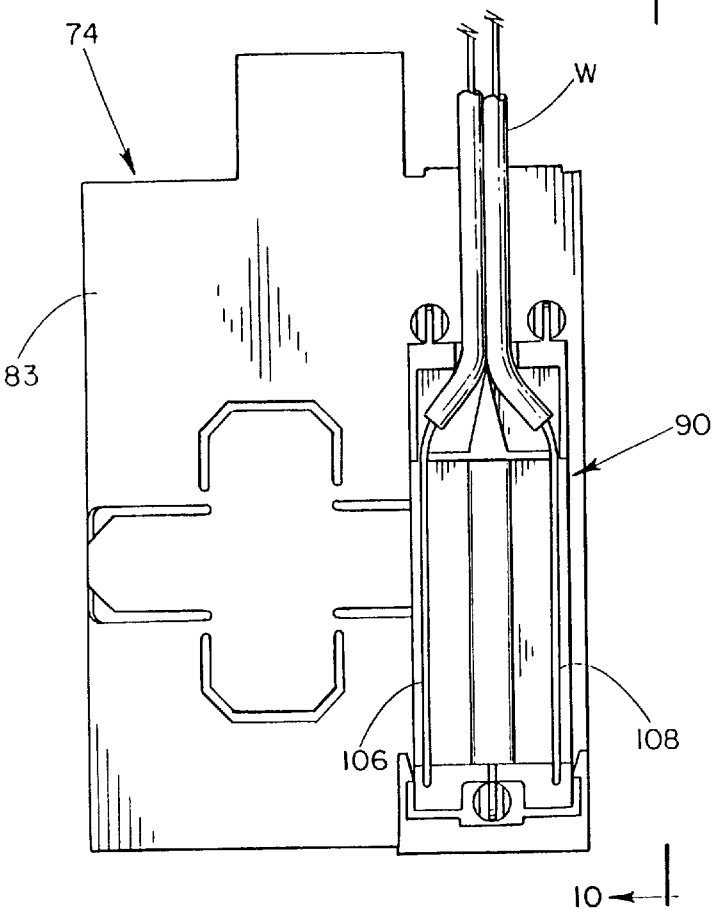
FIG. 9 shows an enlarged front plan view of the ice bank probe secured to the evaporator coil mounting plate.

As seen in FIG. 8, an ice bank sensor 70 and a temperature sensor 72 are secured to a retaining bracket 74 which in turn is releasably securable to evaporator coils 52. As seen by also referring to FIGS. 8, 9 and 10, bracket 74 includes a pair of lower coil retaining arms 76 and a flexible coil engaging tab 78. Bracket 74 also includes a temperature probe guide arm 80 having a guide hole 81 therein, and three ice bank sensor retaining holes 82 extending through a flat vertical surface 83 thereof. Hole 81 provides for slideably receiving the body 84 of temperature sensor 72. Sensor 72 also includes an upper plate 86 for securing to deck 62 and includes a pair of wires 88 for connection to a control means. Ice bank sensor 70 includes a sensor retaining clip 90 having a wire retaining portion 92*a* and a protective portion 92*b*. Protective portion 92*b* is secured to retaining portion 92*a* by a live hinge 94. Retaining portion 92*a* includes elevated end portions 96*a* and 96*b*. Portion 96*a* includes a wire retaining recessed area 98 and return receiving cavities 99, and portion 96*b* includes a pair of probe end retaining holes 100. Portion 92*a* also includes three legs 102 for providing snap fitting retaining thereof with bracket holes 82. Portion 92*b* includes two flexible clip arms 104 having returns 104*a* thereon and a pair of probe protectors 105. Dual wires W, as seen in FIGS. 8 and 9, are partially separated and have some insulation removed therefrom thereby creating probes 106 and 108. Each probe 106 and 108 include bent ends 106*a* and 108*a* respectively for inserting into probe holes 100. It can be understood that wires W are retained within clip 90 wherein after insertion of probe ends 106*a* and 108*a* into holes 100, and an insulated portion of wires W is placed within recessed area 98, portion 92*b* can be secured to portion 92*a*. Specifically, as seen in FIG. 10, clip arms 104 provide for snap fitting securing where returns 104*a* of clip arms 104 provide for snap fitting securing to end portion 96*a* wherein the return retaining slots 99 thereof hold returns 104*a*. Clip 90 can then be secured to bracket 74 by insertion of the legs thereof into holes 82. Bracket 74 is secured to evaporator coils 52 by first receiving an individual coil 52 in arms 76 and then snap fitting flexible tab 78 over a further coil 52. Temperature sensor 72 is secured to dispenser 50 wherein probe body 84 is guided through hole 81 thereof and plate 86 is secured to deck 62. Protectors 105 serve to prevent physical disruption or contact with probes 106 and 108.

Figure 11:
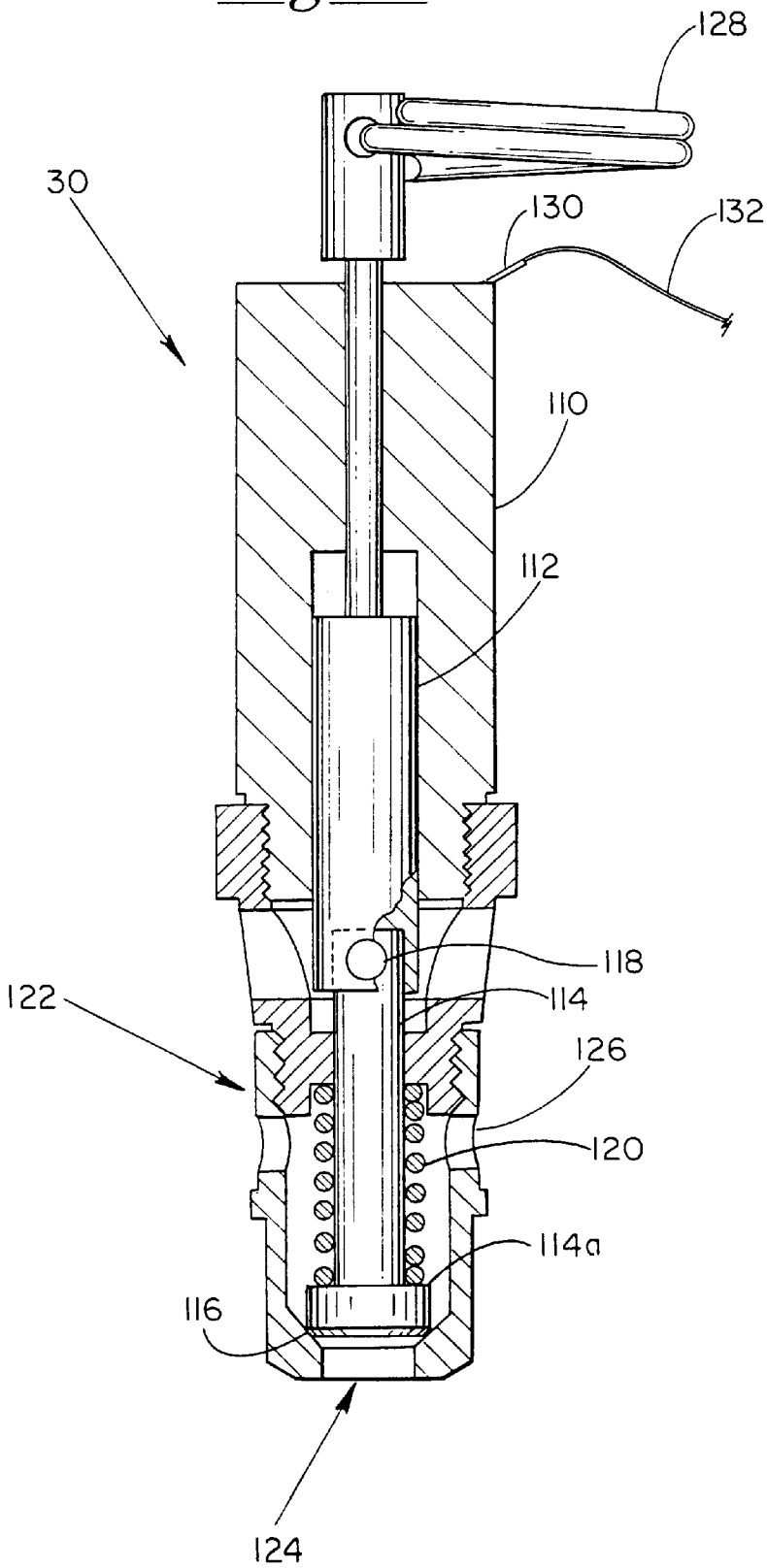
FIG. 11 shows an enlarged cross-sectional view of the solenoid operated safety valve.

As seen in FIG. 11, solenoid valve 30 includes a solenoid 110 and operating arm 112. Arm 112 is connected to a valve arm 114 which includes a valve end 114*a*. Valve end 114*a* provides for sealable seating with seat 116. Valve arm 114 is secured to solenoid arm 112 by a pin 118. A spring 120 extends around arm 114 and provides for biasing seat end 114*a* against seat 116. Valve arm 114 and spring 120 are retained within a lower valve housing portion 122. Housing portion 122 includes a lower hole 124 and a plurality of perimeter holes 126. Arm 112 is also secured to a manual actuating ring 128. Solenoid 110 includes electrical contacts 130 for connection by wires 132 to control means and power circuitry therefore.

Figure 12:
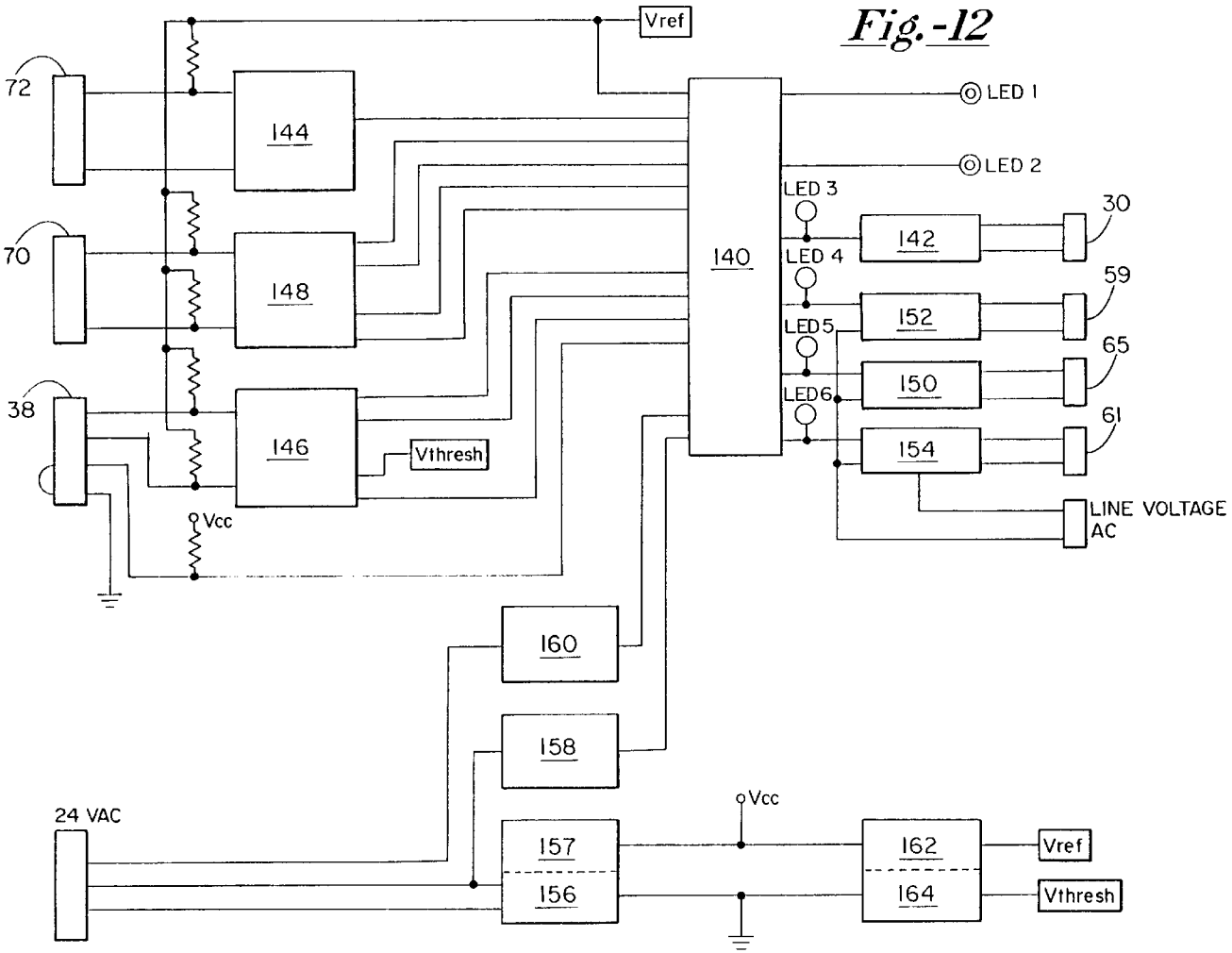
FIG. 12 is an overall schematic diagram of the electronic control of the present invention.

As seen in FIG. 12, the present invention includes a microcontroller 140 for providing electronic control of the safety valve 30, ice bank temperature sensor 72, carbonator probe 38, ice bank sensor 70, agitator motor 65, pump 59, and compressor 61. Valve 30, ice bank temperature sensor 72, carbonator probe 38, ice bank probe 72, agitator motor 65, water pump 59, and compressor 61 each include particular control circuits 142, 144, 146, 148, 150, 152, and 154 respectively associated therewith. Power is supplied to the present invention by power supply circuit 156 having a +5 volt Vcc circuit 157 and a zero crossing circuit 158. The control of the present invention also includes a boost pump circuit 160 and reference and threshold voltage circuits 162 and 164.

Figure 13:
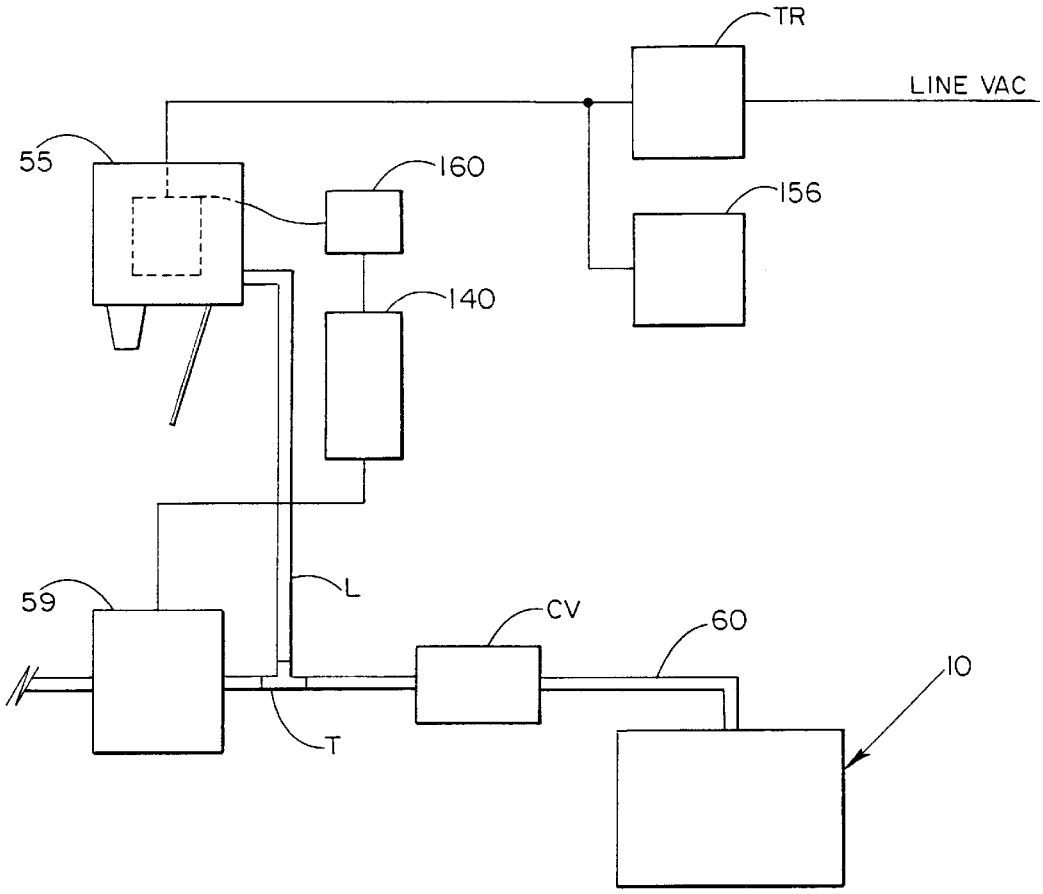
FIG. 13 shows a schematic view of a plain water connection to a dispensing valve.

FIG. 13 shows a schematic diagram of the situation where a beverage valve 55 is connected to a plain water line L coming off a T-fitting marked T. Plain water is supplied to line L by pump 59. Line 60 provides water to carbonator 10, and as is known in the art, a check valve CV is used to prevent carbonated water from exiting back from carbonator 10 into line 60. If the plain water supply is of a low pressure, such as below 30 PSI, pump 59 is turned on by circuit 160 as controlled by microcontroller 140 to provide additional pressure. Transformer TR provides the 24VAC to each solenoid 55*a* of each valve 55. The 24VAC is provided to connector J5 of boost circuit 160, seen in FIG. 18, and as described in further detail below, for operating pump 59. This connection is made at installation of dispenser 50 if the water supply pressure is low. Thus, pump 59 will be operated when a beverage valve 55 using plain water is activated. The water will then flow to that valve 55. Check valve CV along with the pressure in carbonator 10 will prevent the plain water from flowing therein.

Figure 14:
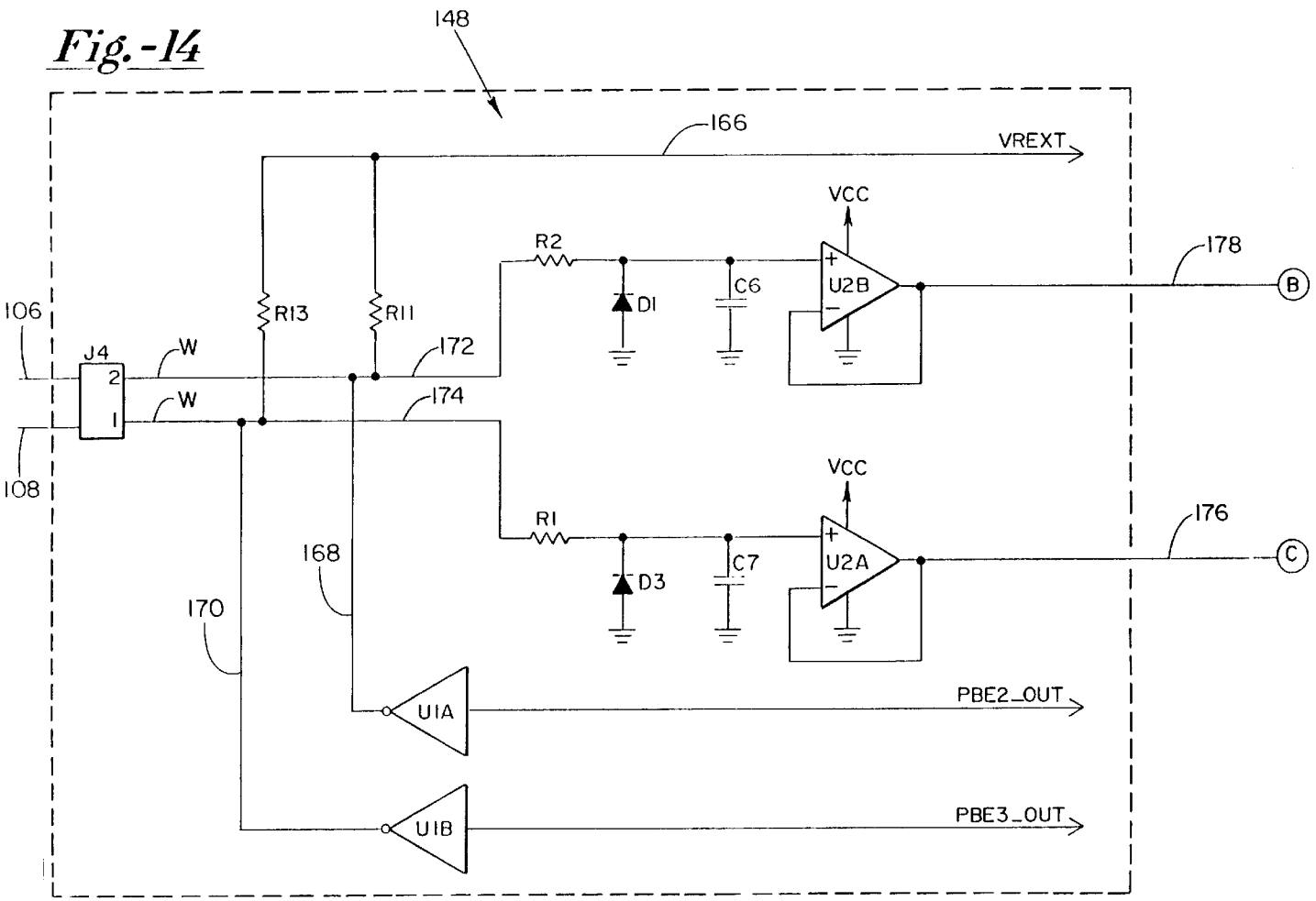
FIG. 14 is a schematic diagram of the ice bank probe control circuitry.
Figure 18:
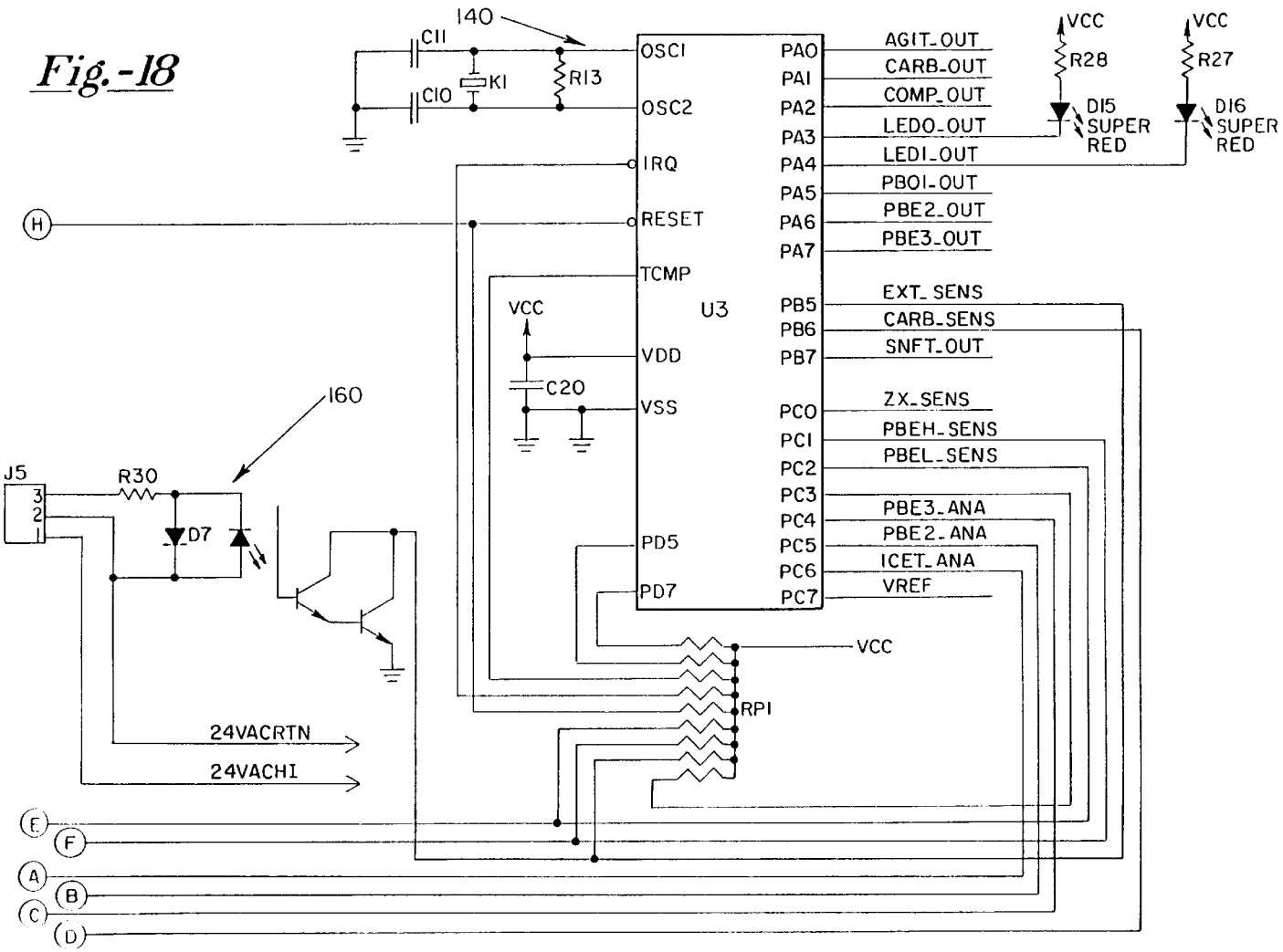
FIG. 18 is a schematic diagram of the boost pumping circuitry and of the microprocessor and connections thereto.

A detailed view of the control circuitry 148 for ice bank sensor 70 is seen by referring to FIG. 14. Circuit 144 includes a line 166 for providing a known reference voltage to a pair of pull-up resistors R11 and R13. Probe wires 106 and 108 are connected by wires W to resistors R11 and R13 respectively. A pair of open collector inverting buffers U1A and U1B are connected via lines 168 and 170 to probes 106 and 108 and resistors R11 and R13 respectively. Lines 168 and 170 in turn provide for connection to a logic ground as represented by microprocessor pins PC4 and PC5, as seen in FIG. 18. A pair of non inverting unity gain op-amps U2B and U2A are connected by lines 172 and 174 to probes 106 and 108 respectively. Each op-amp U2A and U2B include input protection as provided by resistors R1 and R2 diode D3 and D1 and capacitors C7 and C6 respectively. Op-amps U2A and U2B are, in turn, connected to microprocessor 140 along lines 176 and 178.

The operation of circuit 148 can be understood wherein a current coming in along line 166 will normally flow to resistors R11 and R13 to a logic ground through buffers U1A and U1B. When a reading of the conductivity of the water existing between probes 106 and 108 is desired for determining whether or not water or ice is present, electrically current is induced to flow between probe wires 106 and 108 by, for example, the signaling of buffer U1A to switch from ground to an open circuit. Thus, the current will flow through resistor R11 to probe 106 and after a period of time a voltage and current flow equilibrium will reached wherein current will now flow from probe 106 to probe 108 and to logic ground represented by buffer U1B. As this current flow is DC, the direction of current flow between probe wires 106 and 108 is periodically reversed so as to minimize any corrosive effects as a result of the DC current. The specific manner of reversing of such current flow and the sensing thereof by microcontroller 140 will be described in greater detail herein below. Thus, it will be apparent to those of skill, that such a reversal of flow will occur wherein buffer U1B is switched from ground to an open state and conversely buffer U1A is switched from an open state to ground. Thus, current will flow along resistor R13 in the direction from probe 108 to probe 106. It can also be understood that when current is flowing in the direction from probe 106 to 108 op-amp U2B will be able to detect the magnitude of such and report such analog information to microcontroller 140. Microcontroller 140 includes an analog to digital converter which converts the signal from op-amp U2B to a scale of zero to 255 wherein zero represents 0 V and 255 represents 2.5 V. In the same manner, op-amp U2A provides an analog signal proportional to the magnitude of current flow in the direction of probe 108 to probe 106. As stated, an advantage of the present ice bank detecting circuit of the present invention concerns the ability to reverse the direction of flow to minimize any corrosion of either of the probes. Moreover, it can be seen that there is no potential at the probes other than when readings are to be taken, and such readings within a two millisecond window to further prevent any corrosive deposits. It was found that a 4 millisecond threshold current flow time must occur before any corrosive deposition occurs. Thus, keeping such reading time below that threshold will serve to prevent any corrosive deposition on either of the probes.

Figure 15:
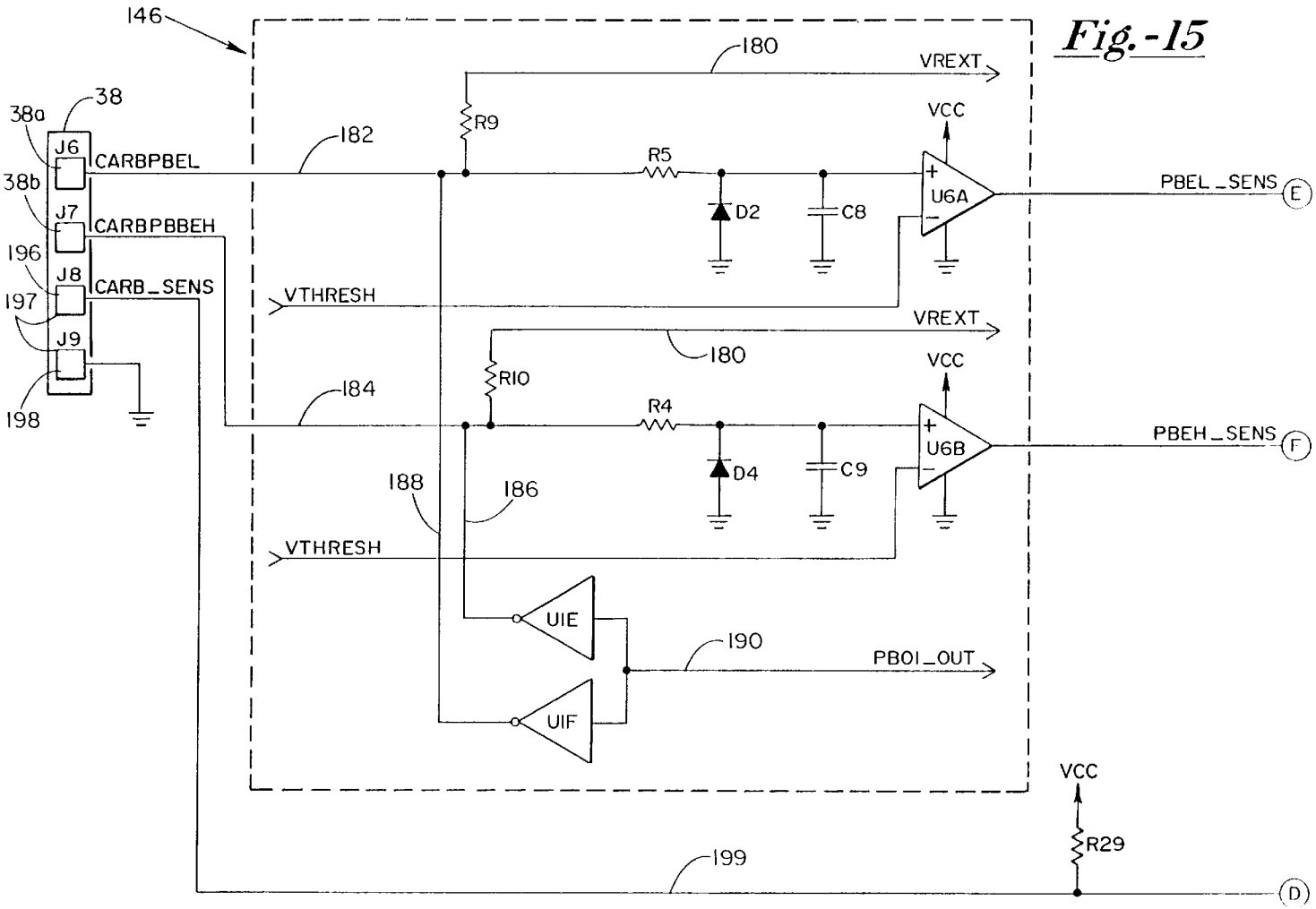
FIG. 15 is a schematic diagram of the carbonator probe control circuitry.

The carbonator probe circuitry 146 is seen in greater detail in FIG. 15. Lines 180 provide reference voltage to resistors R9 and R10. A high level water level sensor probe 38*a* is connected via line 182 to resistor R9 and a lower water level sensor probe 38*b* is connected via line 184 to resistor R10. Open collector inverting buffers U1E and U1F are connected by lines 186 and 188 to lines 184 and 182 respectively. Buffers U1E and U1F are connected to a logic ground via line 190. A comparator U6*a* is connected to line 182 and to a threshold voltage along line 192. Similarly, a second comparator U6*b* is connected to line 184 and connected to the same threshold voltage via line 194. Both comparators U6*a* and U6*b* include resistors R5 and R4, diodes D2 and D4, and capacitors C8 and C9 respectively for providing input protection as is understood by those of skill. Comparators U6*a* and U6*b* have outputs connected to microcontroller inputs A5 and carbonator level sensor also includes a contact 196 connected by jumper 197 to a ground 198 through the carbonator tank 23 which is connected to ground. As an integral part of the level sensor, when the sensor connector is removed from the control, the contact 196 is connected by line 199 to VCC which can be detected by the microcontroller 140. This will prevent the pump operation when no carbonator level sensor is connected to the control.

The operation of the carbonator probe level sensing circuitry is similar to that of ice bank control circuitry 144. In particular, buffers U1E and U1F are generally held at logic ground wherein current flows along lines 180 through resistors R9 and R10 through buffers U1E and U1F of line 190. If a reading of upper level probe 38*a* is to occur, buffer U1F is changed to an open state wherein current will now flow from upper probe 38*a* to the grounded carbonator tank 23. Similarly, if a reading of lower probe 38*b* is to take place, buffer U1B is signaled to change to an open state wherein potential will now form between 38*b* and the grounded tank 23. As with prior art carbonator level sensing probe, sensing of air or water is determined by the difference in resistance to flow there between. However, unlike the situation just described for sensing the presence of water or ice where such differences are proportionately smaller and more subject to variability with respect to purity, or lack thereof, in the water forming the ice bank, the difference in resistance of flow between water and air is quite dramatic. Thus, comparators U6*a* and U6*b* can be used to send a digital signal to microcontroller 140 wherein a high reading will indicate a presence of air and a low reading will indicate the presence of water. Thus, comparators U6*a* and U6*b* only need a threshold of voltage supplied thereto along lines 192 and 194 to which to compare the signals from probes 38*a* and 38*b*. Microcontroller 140 will therefore signal the operation of pump 59 based upon the inputs from circuit 144. A more detailed understanding of the air level probe control logic will be discussed herein below.

Referring to FIG. 18, single chip microcontroller 140 is seen. In the present invention, controller 140 is a model MC68HC05 made by Motorola having a microprocessor, RAM, an onboard A to D converter and the particular programming of the present invention contained in the permanent memory thereof. Crystal X1, capacitors C10 and C11, and resistor R13 form the clock oscillator for microcontroller 140, and capacitor C20 provides power input filtering therefor. The output port pins of microcontroller output directly control the AC outputs to compressor 61, carbonator water pump 59, and agitator motor 65. The low voltage outputs thereof control ice bank sensor 70, carbonator level sensor 38 and their associated circuitry 148 and 146. Two status LEDs (D15 and D16) are directly under software control.

As also seen in FIG. 18, resistor R30, diode D7 and the opto-coupled darlington transistor (ISO1) form a carbonator pump boosting input to the microcontroller. A 24V AC signal applied to pin 3 of J5 will activate pump 59.

Figure 19:
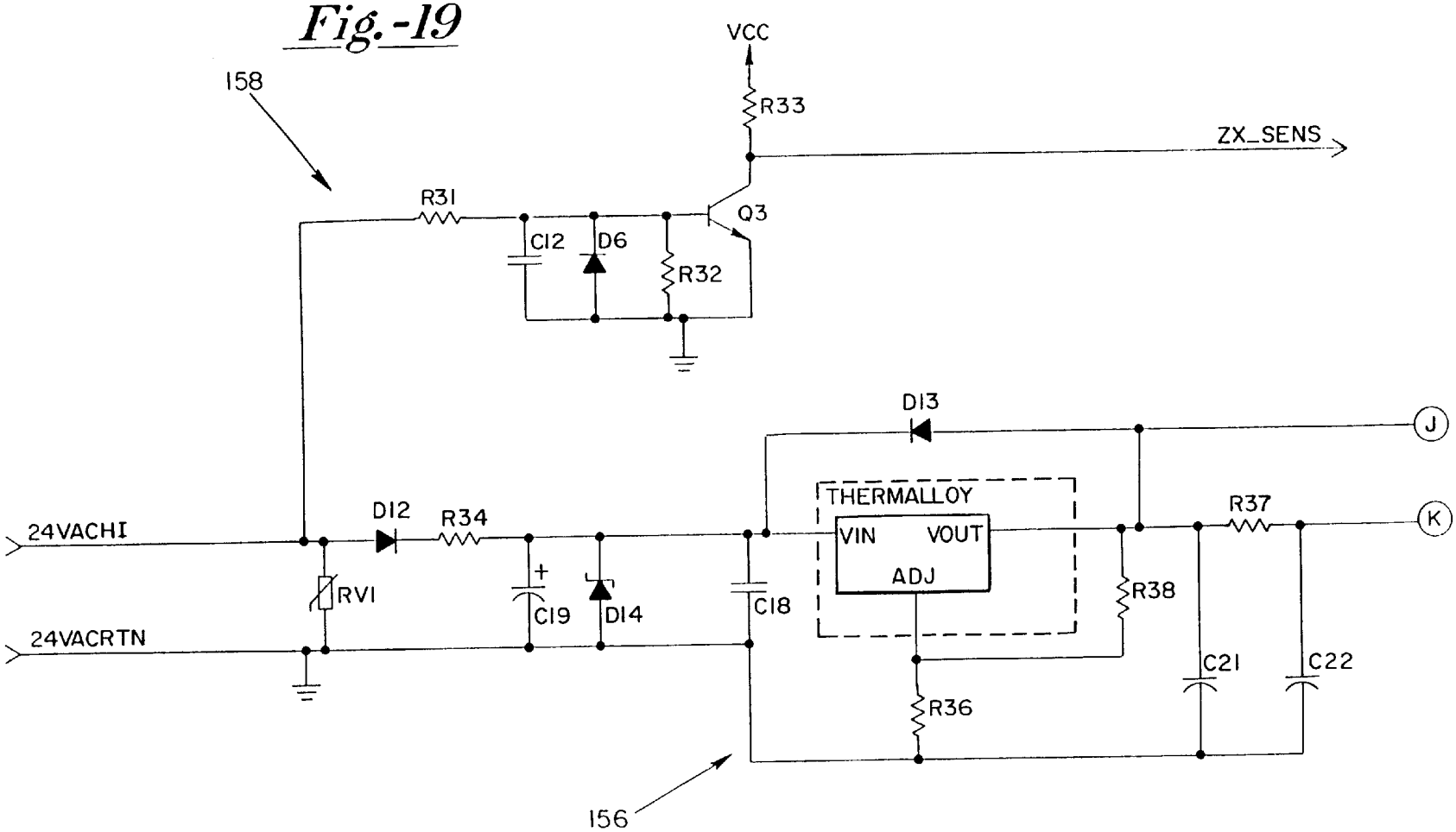
FIG. 19 is a schematic diagram of the power and zero crossing circuitry.

As seen in FIGS. 18 and 19, 24V AC input power is supplied to connector J5 pins 1 and 2. Diode D12, capacitors C19 and C21, voltage regulator U4 and resistors R36 and R38 form a half wave rectified +12V DC power supply. The +12V DC supply has dual use as a pre-regulator for +5V DC "VCC" power supply 158 and the power for the a relay coil T90 seen in FIG. 16. The pre-regulator is necessary to provide reliable operation over a wide input voltage range. Resistor R34 and zener diode D14 are provided for operation at the high limit of input voltages. Diode D13 and capacitor C18 are included as noise filter elements to protect the power regulators from transient voltages developed when switching the compressor relay coil K1. The metal oxide varistor RV1 is included to protect the circuit board from power line transient voltages. Resistor R37 and capacitor C22 provide some additional power dissipation for the +5V DC regulator (U5) to allow operation without a heat sink.

As seen in FIG. 19, a zero-cross circuit 158 consisting of R31, C12, D6, R32, R33 and transistor Q3 provides pulse outputs to an input port pin of microcontroller 140 to indicate when the input AC power is near zero volts. This signal is used to synchronize a compressor relay T90 with the input power to minimize current surges at turn-on and electrical noise spikes at turn-off of the compressor.

Figure 20:
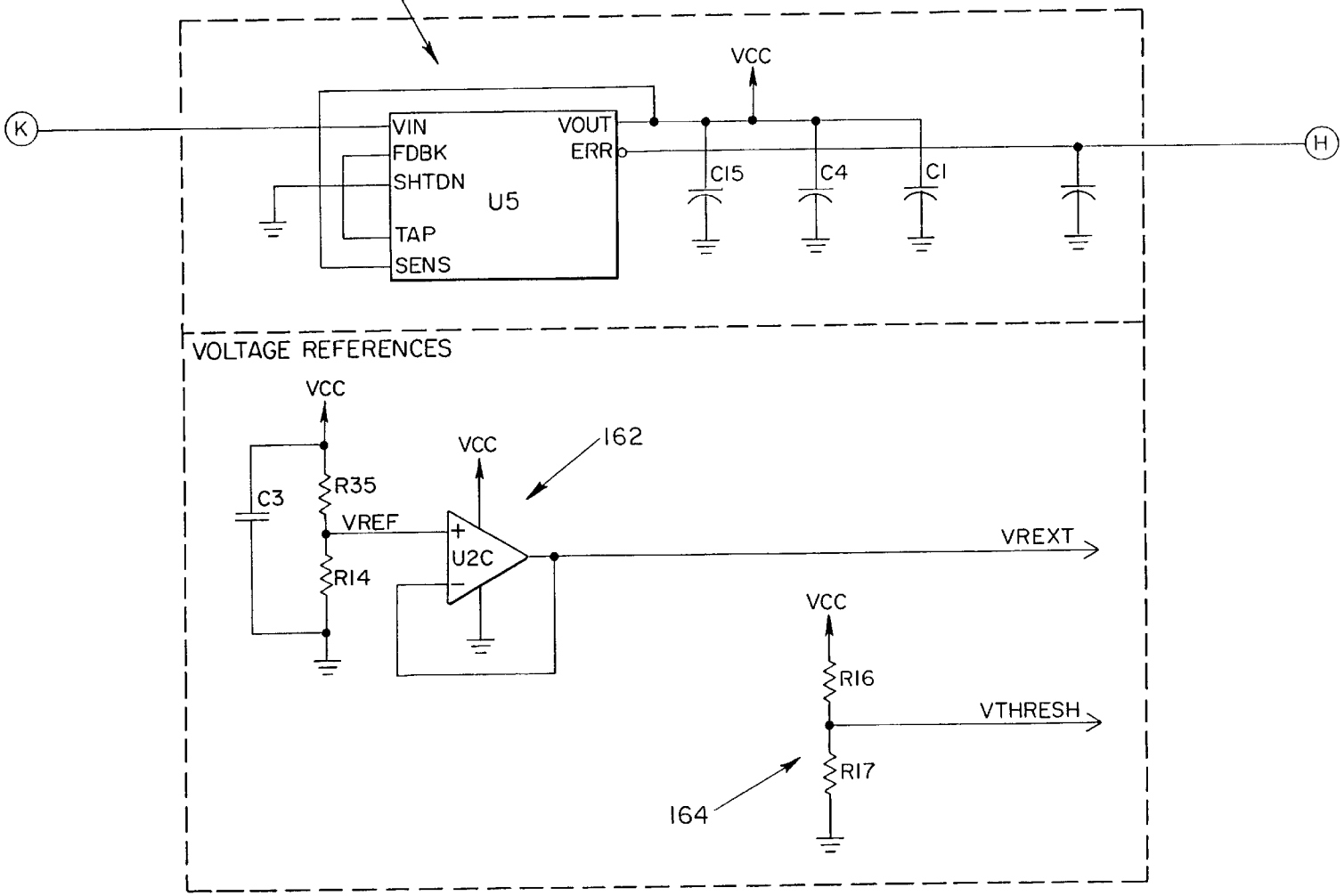
FIG. 20 is a schematic diagram of the voltage regulating and voltage reference circuitry.

As seen in FIG. 20, circuit 157 includes regulator IC (U5) for providing a +5V DC output from the pre-regulated +12V DC input. Capacitors C15, C4 and C1 provide electrical noise filtering for reliable operation of the control. Regulator U5 also monitors the +5V DC power through "sense" input and provides a logical reset signal to microcontroller 140 when power is below the safe operating limit. Capacitor C23 provides additional reset pulse filtering to microcontroller 140.

The ice bank temperature, ice bank continuity and carbonator level detect circuits 144, 148 and 146 require a stable voltage reference to measure their respective parameters. As seen in FIG. 20, circuit 162 includes resistive divider R35 and R14 with capacitor C3 to divide the +5V DC in half to +2.5V DC. An operational amplifier (U2C) buffers the +2.5V signal with a low-impedance driver to isolate the off-board components from the on-board components to minimize electrical noise interference on the control board.

The carbonator circuit comparators U6A and U6B need a voltage threshold to compare against the input signals to make a logic level decision whether the probes are in "air" or "water". Resistors R16 and R17 divide the +5V DC "VCC" to provide the threshold signal. Since the signal does not leave the circuit board, no additional buffering with an op-amp is needed.

Figure 16:
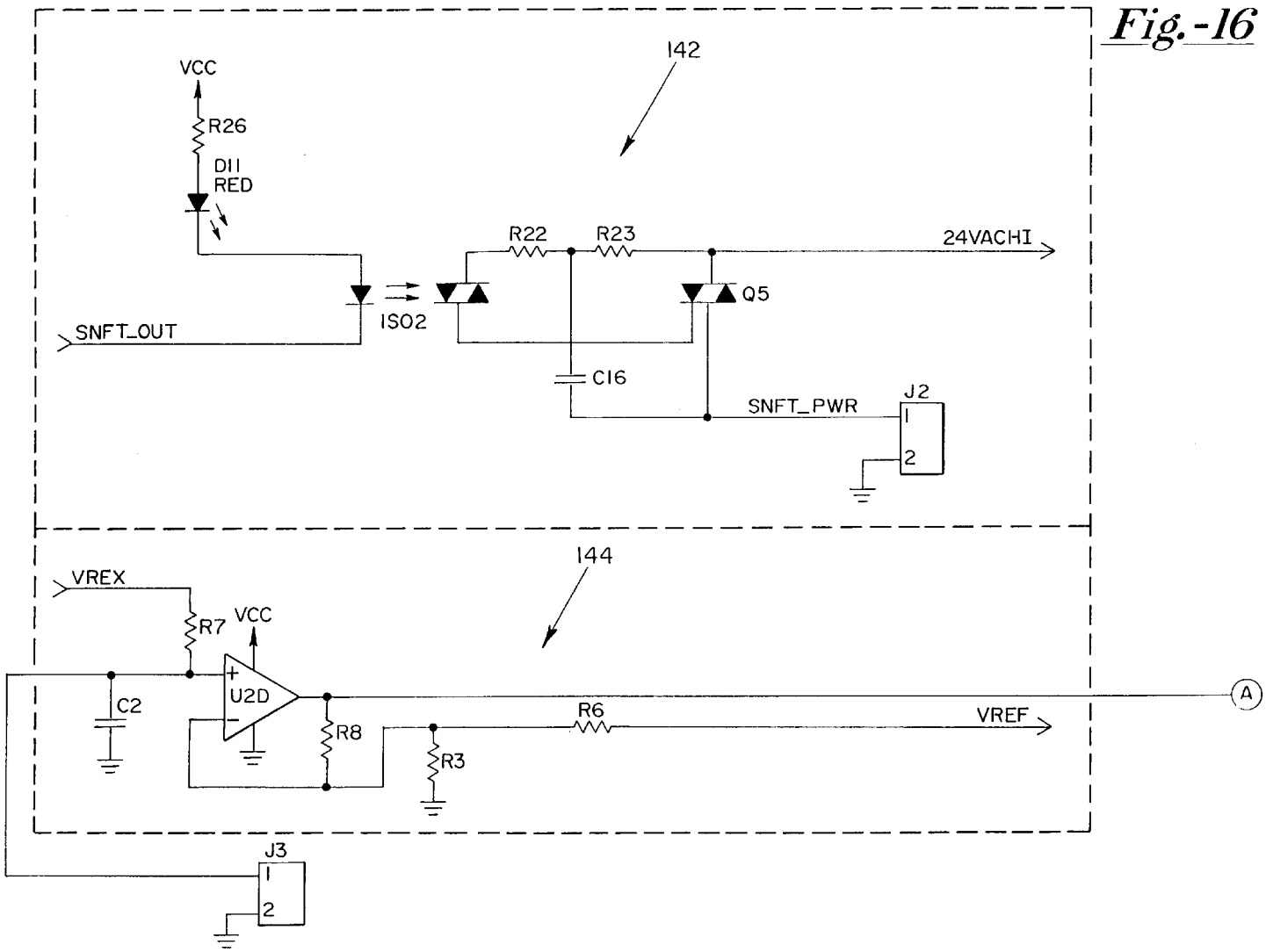
FIG. 16 is a schematic diagram of the solenoid operated safety valve and the temperature sensing control circuitry.

As seen in FIG. 16, the ice bank temperature thermistor sensor circuit 144 forms a voltage divider circuit with resistor R7 and filter capacitor C2. The operational amplifier U2D provides all the signal conditioning needed to expand the sensor usable signal range to cover the expected ice bank temperature range. Resistors R3, R6 and R8 provide the needed gain and offset.

Figure 17:
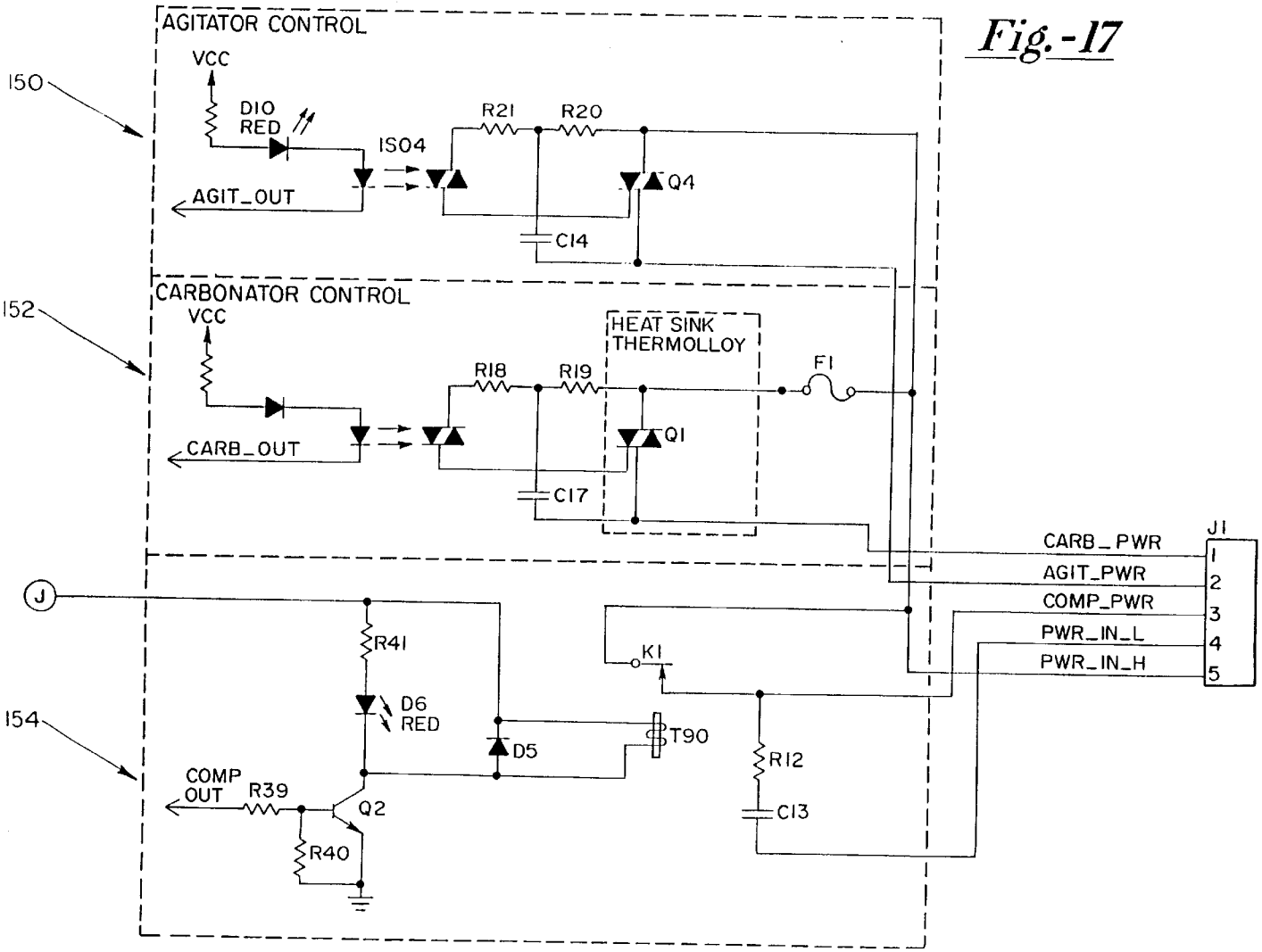
FIG. 17 is a schematic diagram of the agitator motor, the carbonator and the compressor control circuitry.

As seen in FIG. 17 with respect to agitator control circuit 150, microcontroller output port pin controls the LED half of an optically coupled triac driver ISO4. In addition, when the agitator output is active, LED D10 will also be illuminated. The output power for agitator motor 65 is directly switched through triac Q4. Resistors R20, R21 and capacitor C14 form a "snubber" circuit to provide reliable "switching" operation.

As seen in FIG. 17 with respect to carbonator pump circuit 152, a microcontroller output port pin controls the LED half of an optically coupled triac driver ISO3. In addition, when the carbonator output is active, LED D9 will also be illuminated. The output power for carbonator motor 59 is directly switched through a heavy duty triac Q1, which is attached to a heat sink to dissipate heat when pump 59 is running. Resistors R18, R19 and capacitor C17 form a "snubber" circuit to provide reliable "switching" operation. Fuse F1 is included in the output to protect the circuit components if pump motor 59 becomes stalled, since motor 59 has no internal overcurrent protection.

As seen in FIG. 17 with respect to compressor control circuit 154, a microcontroller output port pin controls a transistor switch formed by Q2 and resistors R39 and R40. In addition, when the compressor output is active, LED D8 will also be illuminated. Diode D5 protects the transistor switch from electrical transients which occur when the relay is switched off. The output power for compressor 61 is directly switched through the relay contacts. Resistor R12 and capacitor C13 form a "snubber" circuit to provide long reliable contact life while reducing electrical noise interference.

As seen by referring to FIG. 16 with respect to safety valve control circuit 142, a microcontroller output port pin controls the LED half of an optically coupled triac driver ISO2. In addition, when the safety valve output is active, LED D11 will also be illuminated. The output power for valve 30 is directly switched through triac Q5. Resistors R22, R23 and capacitor C16 form a "snubber" circuit to provide reliable "switching" operation.

An understanding of the operation of the present invention can be had by referring to the flow diagrams contained in FIGS. 21 through 26. It will be understood, by those of skill, that microcontroller 140 includes specific programming for operating the various components of a beverage dispenser. Such flow diagrams being illustrative of the control of such components as exercised by microcontroller 140 as a function of its specific programming.

Figure 21:
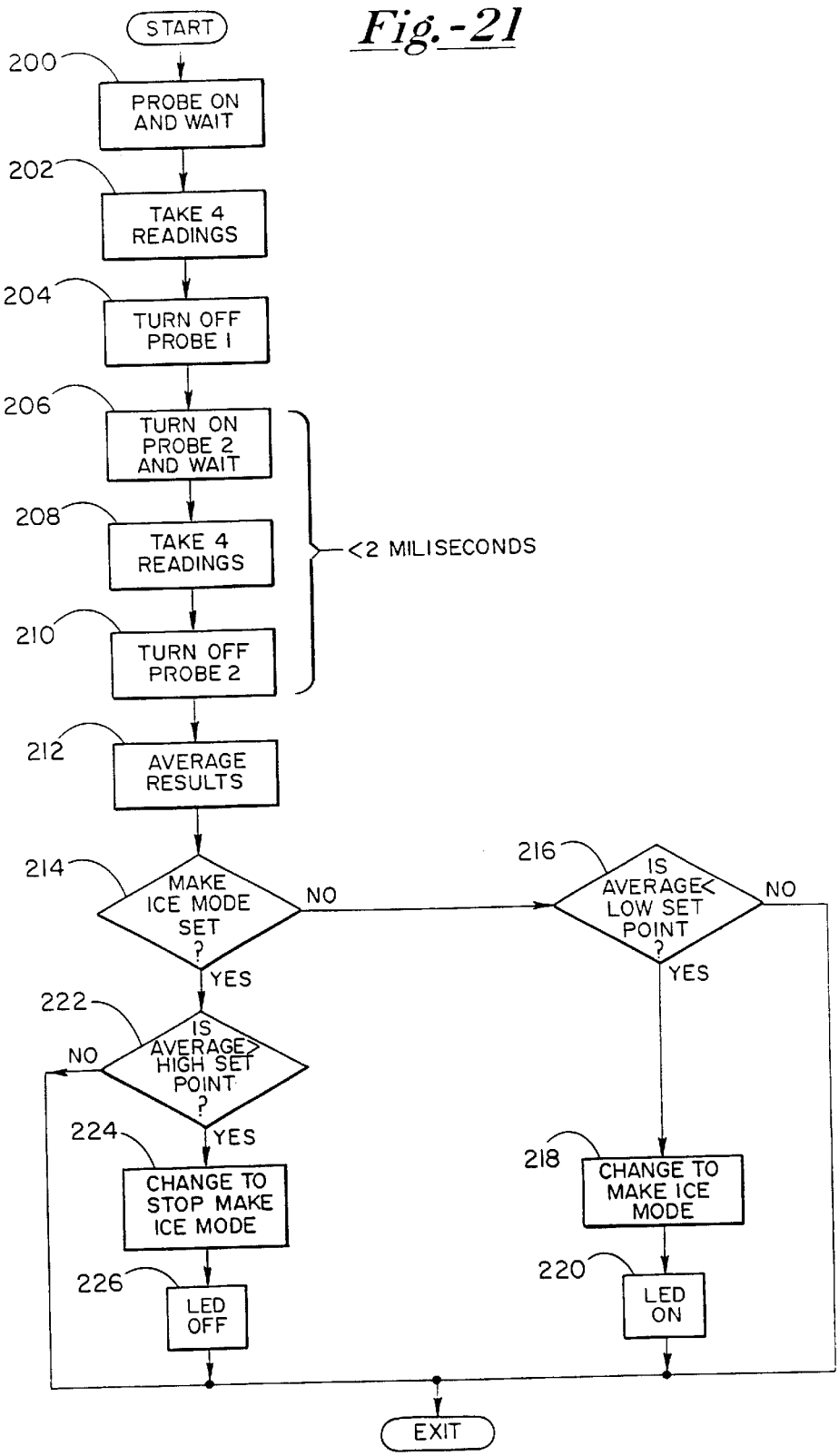
FIG. 21 is a flow diagram of the microprocessor control of the ice bank probe and the data received therefrom.

A more detailed understanding of the operation of ice sensor 70 and related circuit 148 can be had by referring to FIG. 21. As seen therein, current is made to flow from probe 106 to 108 by energizing of buffer U1A. Four individual readings are taken wherein buffer U1B is switched between an open state and logic ground four times with a suitable wait period there between to provide for the voltage and current flow to stabilize. At block 204 buffer U1A is switched to logic ground after which buffer U1B at block 206 is switched to an open state. Block 208 four readings are taken by op-amp U2A current flow from probe 108 to 106 as a result of the cycling between an open state and logic ground by buffer U1B. At block 210 both buffers U1A and U1B are held to a logic ground. At block 212 there now exists eight individual conductivity readings wherein the highest two and lowest two such readings are thrown out and the remaining four readings are averaged. Decision block 214 the microcontroller determines whether or not a make ice mode is set. Thus, if microcontroller 140 has previously determined that ice should be made, the make ice mode will have been set as will become more clear in the following flow diagram. If the make ice mode is not set, then at decision block 216 it is determined as calculated by block 212, is below a low set point. The low set point is a resistance level that has been chosen therein if the resistance determined by sensor 90 is below this level then water is indicated and a change to a make ice state occurs at block 218 then LED 1 is turned on at block 220. If however, at decision block 216 the average is greater than the low set point, no change in state is indicated and this routine is exited. If at decision block 214 the make ice mode is set, then at decision block 222 it is determined if the average resistance value calculated at block 212 is greater than a high set point. The high set point is a resistance level selected as being indicative of ice being present covering probes 106 and 108. If the average calculated at block 212 is greater than the high set point, then the microprocessor changes to a stop make ice state after which LED 1 is turned off at block 226. If at decision block 222 the average determined at block 212 is less than the high set point, then no change in the ice mode is made and the routine is exited.

Figure 22:
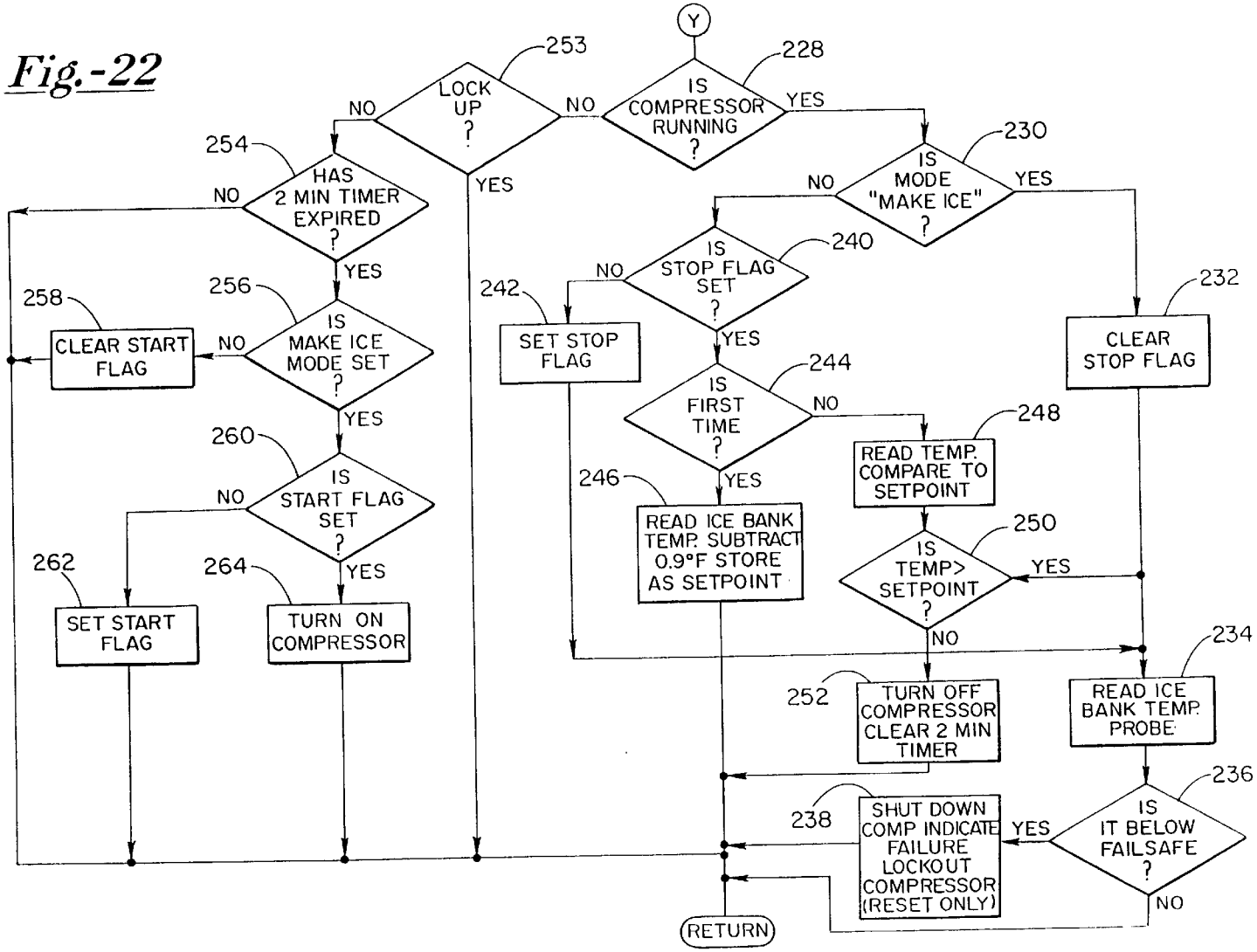
FIG. 22 is a flow diagram of the microprocessor control of compressor.

The programmed control of compressor 61 can be understood by referring to FIG. 22. As seen therein at block 228 it is first determined whether or not compressor 61 is running. If the answer is yes, at decision block 230 it is determined whether or not the program is in the make ice mode. If the compressor and it is the make ice mode then a stop flag is cleared at block 232 after which at block 234 the ice bank temperature probe 70 is read and at decision block 236 it is determined if the temperature is below a fail safe level. This fail safe temperature is experimentally determined as a temperature indicating that the ice bank, for whatever reason, has grown too large, thereby indicating some sort of mechanical and/or electronic failure. Thus, at block 238 the compressor is shut down, failure is indicated. The compressor startup is locked out wherein the compressor can only be restarted by a manual reset. If at decision block 230 the routine is not in the make ice mode at decision block 240 the decision is made whether or not the stop flag is set. If it has not been set at block 240 it is set and the routine flows through to return. On a subsequent time through at decision block 240 the decision will be that the stop flag is set. The reason for the stop flag is that the sensing of the presence of ice by ice bank sensor 90 and as per the flow diagram of FIG. 21 and the running of the present compressor control regime occur every 30 seconds. Thus, requiring stop flags ensures that at least two measurements are taken 30 seconds apart with respect to the decision of whether to turn off compressor 61. This approach provides for added assurance that ice bank probes 106 and 108 indeed are covered with ice as opposed to a transient situation. Continuing, at decision block 244 routine asks is this the first time through. In the present case since this will be the first time through and at decision block 246 ice bank temperature probe 72 is read and 0.9° F. is subtracted from that currently sensed temperature and stored as a set point. The next time through, assuming the compressor is running, make ice mode is yes, stop flag is set at decision block 246, this will now be the second time through, for purposes of this discussion, after which at block 248 the current temperature is read and compared with the previous stored set point. If at decision block 250 the read temperature is greater than the set point then the compressor is left running and again cycles through blocks 234, 236, and 238. If the sensed temperature is less than the set point then at block 252 turn off the compressor and clear a two minute timer. The reason for the "first time" question block 246 is to provide a set temperature point for determining when the compressor should be turned off. It was experimentally determined that the 0.9° F. increment that must be reached at decision block 250 before compressor 61 can be turned off. Thus, compressor 61 is not turned off immediately when ice is determined to be covering probes 106 and 108, but is allowed to run and develop additional ice beyond probes 106 and 108. In the particular embodiment described herein, the 0.9° F. was found to provide for the desired additional amount of ice bank deposition. It can be appreciated by those with skill that decision block 246 permits a fixing of that ice temperature set point so that the routine can subsequently flow to block 248. Otherwise, the set point would be changed each time and the compressor would not turn off. If at block 228 it is determined that the compressor is not running, at decision block 253 it is first determined if the compressor is in lock up. If it is the routine goes to return and compressor can not be started. If it is not in lock up, at decision block 254 it is determined whether or not the two minute timer has expired. If not, the routine flows to the return and repeats. If subsequently it is determined that the two minute timer had expired then at decision block 256 it is determined whether or not we are in the make ice mode. If it is not in the make ice mode at block 258 a start flag is cleared. If at block 256 it is the make ice mode, then at decision block 260 it is determined if this is the second time through. If it is not, the start flag is set; if it is, the compressor is turned on at block 262 the start flag is set. An understanding of the foregoing wherein at block 254 a two minute timer must expire from the last time compressor 61 was turned off before it can be turned on. This, of course, provides for a short cycling protection. Moreover, compressor 61 is not turned on at block 264 until at block 260 it is determined that this is the second time through the routine. Thus, at least two determinations 30 seconds apart must confirm that probes 106 and 108 are sensing water.

Figure 23:
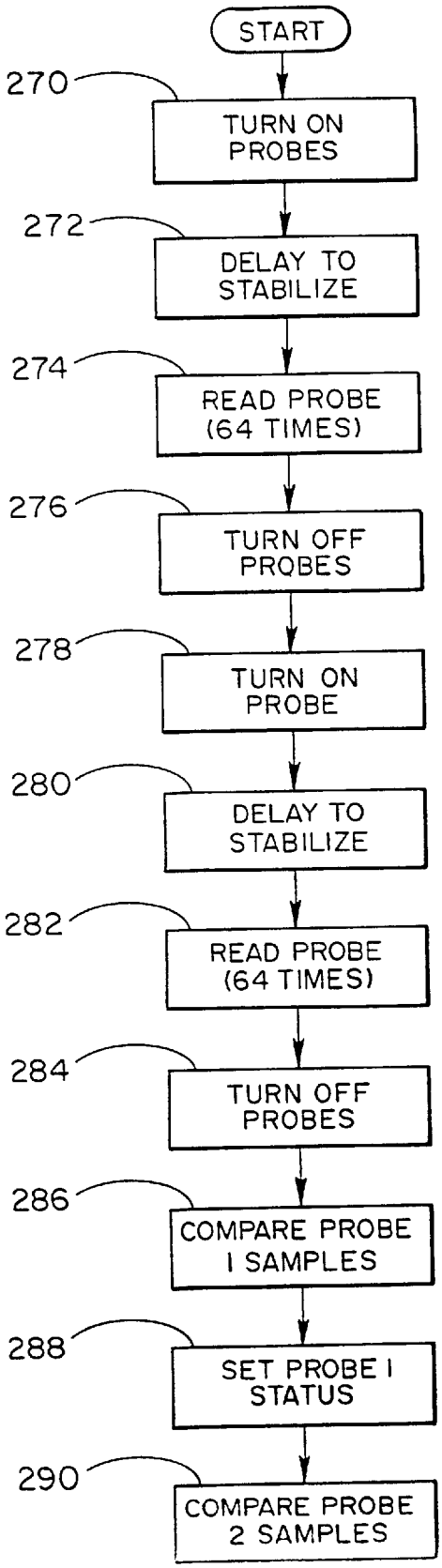
FIG. 23 is a flow diagram of the microprocessor control of carbonator probe and the data received therefrom.

The control of the carbonator probes can be understood by referring to FIG. 23. At block 270 high and low probe 38*a* and 38*b* are turned on and the logical signal is sent along line 192 to buffers U1E and U1F. Though both probes are turned on simultaneously, unlike the situation with ice bank probes 106 and 108, there is not need to reverse current flow that would result in flow from carbonator tank 23 to the probes. However, as with probes 106 and 108 each probe 38*a* and 38*b* is read individually although there will be a potential at both. Thus, at block 272 after a suitable delay period at block 274 probe 38*a* is read 64 times during a total on time of less than 4 milliseconds and generally approximately 2 milliseconds. The signal along line 192 then provides for turning off buffers U1E and U1F at block 276. The probes are then turned on again at block 278 after a suitable delay time to allow the voltages to stabilize at block 280 probe 38*b* is read 64 times, again within the same time frame as the readings occurring at probe 38*a*. At block 284 the probes are again turned off. At block 286 the 64 samples of probe 38*a* are read and if a majority indicate the probe is in air then that status is set at block 288. Or if the majority of readings indicate that the probe is in water, that particular set is set at block 288. At block 290 the same procedure occurs for the readings taken with respect to sensor 38*b*. Then at block 292 if the majority of readings indicate air or water, that particular status is set. It will be apparent to those with skill that the readings of the carbonator level probes will be received by microcontroller 140 as digital information rather than the analog information provided by ice bank probes circuit 148. So, at blocks 288 and 292 the probe status will remain the same as it previously was if the number of readings for water or air at any one probe are equal.

Figure 24:
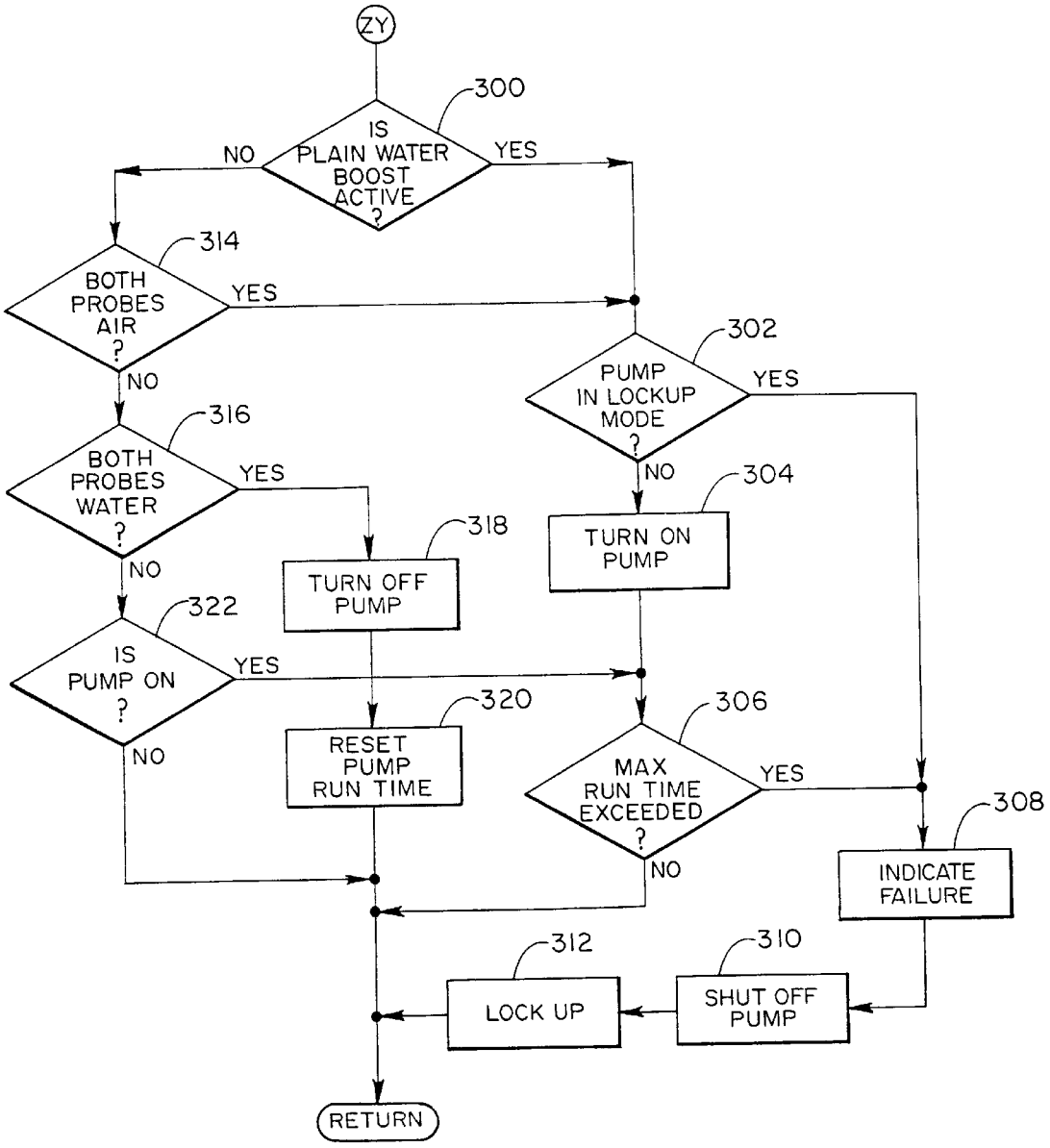
FIG. 24 is a flow diagram of the microprocessor control of plain water pump.

An understanding of the control of water pump 59 as a function of the determination of the water level sensor 38 it can be had by referring to FIG. 24. At decision block 300 it is first determined if the plain water boost is active. As previously described the plain water boost is activated if incoming plain water pressure is not sufficient for providing flow of plain water to one of the valves. Thus, we are not concerned at this point whether or not the carbonator needs water as pump 59 is being operated to provide plain water to one of the valves. At decision block 302 we must first determine if pump 59 is in a lockup mode. If it is not, at block 304 we turn on pump 59. At decision block 306 we determine if the maximum run time of pump 59 has been exceeded. If it has we indicate failure at block 308, shut off pump 59 at block 310 and lockup the operation of pump 59 at block 312 so that restarting must require service personnel. If at decision block 306 the maximum run time has not been exceed then we can go to return. It can be appreciated by those with skill that decision block 306 provides a safety measure wherein if pump 59 has been running for a continuous period of time, for example, more than five minutes the failure is indicated such as a ruptured line for which the operation pump 59 should be terminated. If at decision block 300 plain water boost is not active, then the set values for probes 38*a* and 38*b* are reviewed. If at block 314 both probes are determined to be in air, then the pump will be turned on provided it is not in lockup. If at block 316 it is determined that both probes are in water and block 318 pump 59 is turned off and the maximum run time timer is reset at block 320. If at decision block 322, which we have reached because probes 38*a* and 38*b* do not agree, that is they are not both in water or both in air, it is determined if the pump is on. If it is it is allowed to run unless at block 306 the actual run time is exceeded. If the pump is not on, it is left off. Thus, if probes 38*a* and 38*b* are indicating the opposite condition, either air or water, from the other, then the current state is not changed and the pump is allowed to either run or not run depending on that current state.

Figure 25:
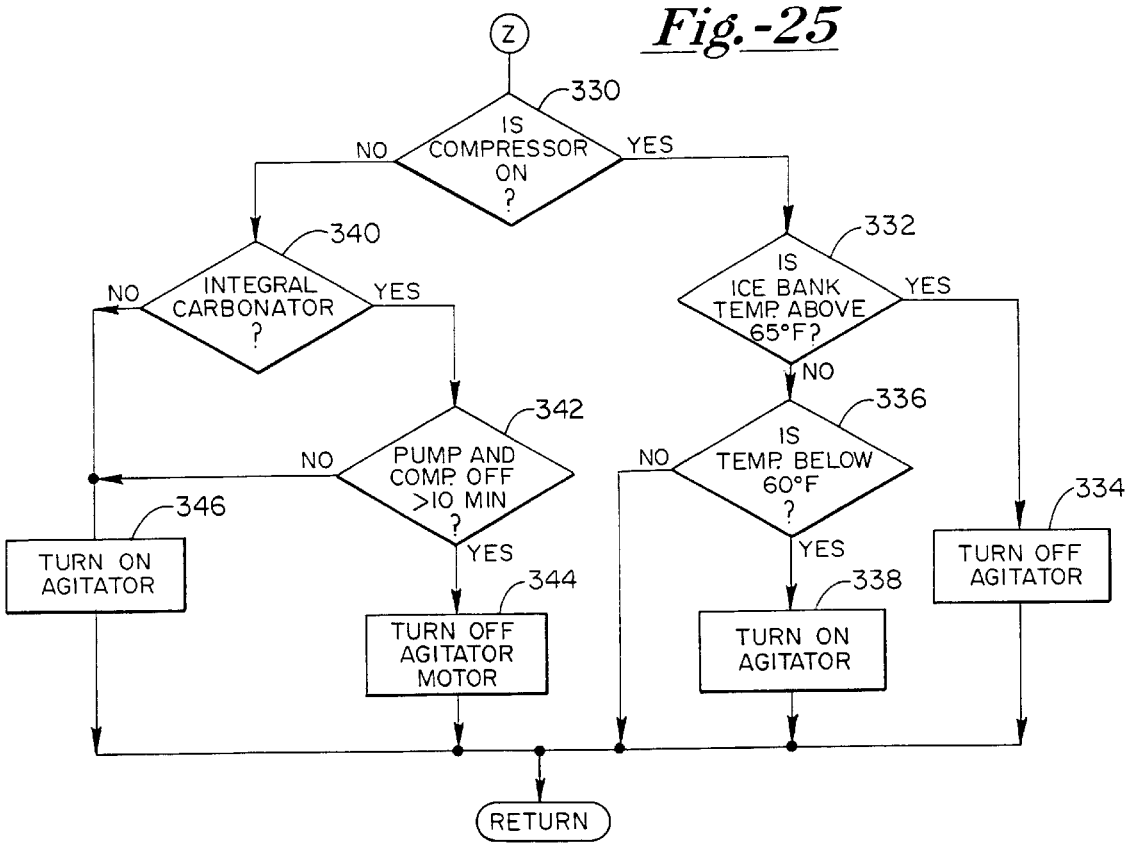
FIG. 25 is a flow diagram of the microprocessor control of agitator motor.

Appreciation of agitator motor 65 can be understood by referring to the diagram of FIG. 25. At decision block 330 it is determined if compressor 61 is on. If it is on at decision block 332 it is determined by temperature probe 72 if the ice bank temperature is above 65°. If it is, agitator 65 is turned off at block 324. If the ice bank temperature is below 65° at decision block 326 it is determined if the ice bank temperature is below 60° F. If the temperature is between 65° and 60° F., no change is made to the current operation of the agitator, whether it be on or off. If, however, temperature at block 326 is determined to be below 60° F., then agitator 65 is turned on at block 328. Blocks 322 through 328 provide for control of agitator 65 at initial pull down, that is startup of dispenser 50 wherein no ice bank has of yet formed. Typically, in an initial pull down situation a compressor would run until it trips off because of the great cooling demand. This demand of course was exacerbated by the fact that, to quote prior art, dispenser the agitator motor would be running continuously. It was found that if the agitator motor were turned off in situations where the temperature was sensed to be above 65° compressor 61 would not have to run as much and would not run until it would trip off as a result of a safety in the compressor motor itself. Thus, agitator 65 would only be run if the temperature reached a lower value such as 60° F. Of course, the 5° range between 60° and 65° provides for a hysteresis of management. It was found that this strategy provides for initial pull down to a full formation of a desirable ice bank in a shorter period of time than if the agitator motor were allowed to run constantly. If at block 330 the compressor is found to be off at decision block 340 is determined whether or not a carbonator 10 is located within the ice bank. If it is not, the agitator is turned on and left running. Thus, in a non-integral carbonator situation, that is a remote carbonator, the agitator motor run continuously. If, however, the carbonator is located within the ice bank then at decision block 342 it is determined if water pump 59 and compressor 61 have both been off for a period of time greater than ten minutes. If both have been off for a period of time greater than ten minutes, then at block 344 agitator motor 65 is turned off. If, however, both pump 59 and compressor 61 had been not been off for a period of time greater than ten minutes then agitator motor 65 is turned on. In this manner, it can be appreciated that agitator motor 65 is only run in situations where pump 59 and/or compressor 61 had been running. In other words, the operation of agitator 65 is correlated to the drawing of drinks and/or the building of ice banks which is directly indicative of dispensing of drinks. Where in both situations cooling of beverage constituents is required. However, if pump 59 and/or compressor 61 had not been active for a period greater than ten minutes, this indicates that no drinks are being drawn and the operation of agitator 65 is unneeded. This is especially true of long periods of non-use such as overnight, where continuous operation of agitator 65 would result in erosion of the ice bank which would have to be replaced by operation of the compressor. Thus, not only is some energy saved by not running the agitator, a significant amount of energy is saved by not having to run the compressor to replace needless erosion caused by the agitator during periods of non-use.

Figure 26:
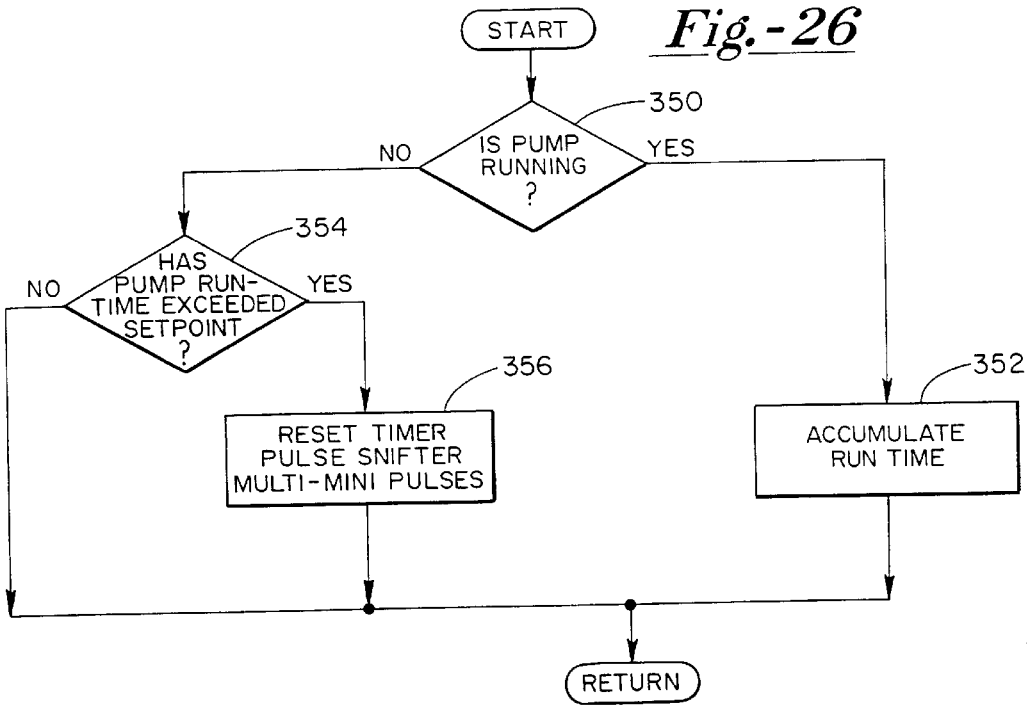
FIG. 26 is a flow diagram of the microprocessor control of solenoid operated carbonator safety valve.

The control of safety valve 30 can be understood by the flow diagram seen in FIG. 26. At decision block 350 it is determined if water pump 59 is running. If it is, that total run time is accumulated at block 352. If the pump is not running at decision 354 it is determined if the pump run time accumulated at block 352 has exceeded a predetermined set point. If it has not, the pump is allowed to continue running. If it has, then the accumulation of run time is reset at decision block 356 and the solenoid of safety valve 30 is operated to release gases from carbonator 10. In particular, valve 30 is pulsed rapidly rather than held open so that the gases in carbonator 10 are allowed to be released in small amounts. In this manner, the release of such gas does not cause undesirable noise.

What is claimed is:

1. A method for regulating the filling of a tank with a liquid, the tank having an interior volume and an inlet connected to a source of the liquid for introducing the liquid into the interior volume, and an upper electrical probe and a lower electrical probe located within the tank interior volume and each probe connected to a control and the control including conductivity sensing means for sensing electrical conductivity between each probe and the tank separately, and the control regulating flow of the liquid into the tank interior volume, the method for filling comprising the steps of:

providing an electrical potential to the upper and lower probes, making a plurality of electrical conductivity sensing readings at substantially the same time between the upper probe and the tank and between the lower probe and the tank, determining if liquid is present or not at the upper probe and at the lower probe based on the majority of the electrical conductivity readings indicating the presence of the liquid or not at each probe respectively, initiating a flow of the liquid into the tank interior if it is determined that no liquid is present at both the upper and lower probes or stopping any flow of water into the tank interior if it is determined that liquid is present at both the upper and lower probes or if the probes do not agree as to the presence or not of liquid, not changing the current state of introducing liquid into the tank interior volume or not.

2. A method for regulating the filling of a tank with a liquid, the tank having an interior volume and an inlet connected to a source of the liquid and a pump for introducing the liquid into the interior volume, and an upper electrical probe and a lower electrical probe located within the tank interior volume and each probe connected to a control and the control including conductivity sensing means for sensing electrical conductivity between each probe and the tank separately, and the control connected to and operating the pump for regulating flow of the liquid into the tank interior volume as a function of the conductivity sensings of the probes, the method for filling comprising the steps of:

providing an electrical potential to the upper and lower probes, making a plurality of electrical conductivity sensing readings at substantially the same time between the upper probe and the tank and between the lower probe and the tank, determining if liquid is present or not at the upper probe and at the lower probe based on the majority of the electrical conductivity readings indicating the presence of the liquid or not at each probe respectively, operating the pump to initiate a flow of the liquid into the tank interior if it is determined that no liquid is present at both the upper and lower probes or stopping any flow of water into the tank interior if it is determined that liquid is present at both the upper and lower probes or if the probes do not agree as to the presence or not of liquid, not changing the current state of introducing liquid into the tank interior volume or not introducing liquid into the tank.

3. The method as defined in claim 2 and the control shutting off the operation of the pump if the pump has been running for a predetermined period of time.

4. The method as defined in claim 2 and the pump also providing water to one or more dispensing valves and including the further step of not initiating filling of water into the tank interior volume, regardless if it is determined that filling of the tank is required, if the it is also determined that the pump has been running for a predetermined period of time.

5. A beverage dispensing machine, comprising:

A carbonator tank having an interior volume and an inlet connected to a source of water, a pump connected to a source of the water for introducing the water into the tank interior volume, a level sensor within the tank interior and including an upper electrical probe and a lower electrical probe and each probe connected to a control and the control including conductivity sensing means for sensing electrical conductivity between each probe and the tank separately, and the control connected to and operating the pump for regulating flow of the liquid into the tank interior volume as a function of the conductivity sensings of the probes whereby an electrical potential is provided to the upper and lower probes so that a plurality of electrical conductivity sensing readings can be made at substantially the same time between the upper probe and the tank and between the lower probe and the tank for determining if liquid is present or not at the upper probe and at the lower probe based on the majority of the electrical conductivity readings indicating the presence of the liquid or not at each probe respectively, and the control operating the pump to initiate a flow of the liquid into the tank interior if it is determined that no liquid is present at both the upper and lower probes or stopping any flow of water into the tank interior if it is determined that liquid is present at both the upper and lower probes or if the probes do not agree as to the presence or not of liquid, not changing the current state of introducing liquid into the tank interior volume or not introducing liquid into the tank.

6. The dispenser as defined in claim 5 and the control shutting off the operation of the pump if the pump has been running for a predetermined period of time.

7. The dispenser as defined in claim 5 and the pump also providing water to one or more dispensing valves and the control programmed not to initiate filling of water into the tank interior volume, regardless if the control senses that filling of the carbonator tank is required, if the control has also determined that the pump has been running for a predetermined period of time.

* * * * *